US012527444B2

(12) United States Patent
Unger et al.

(10) Patent No.: US 12,527,444 B2
(45) Date of Patent: Jan. 20, 2026

(54) RECYCLABLE PACKAGE FOR DISPOSABLE WIPES

(71) Applicant: The Procter & Gamble Company, Cincinnati, OH (US)

(72) Inventors: Alexander Eberhard Unger, Kelkheim (DE); Christian Kohlweyer, Bad Vilber (DE); Christian Seib, Bad Friedrichstall (DE)

(73) Assignee: The Procter & Gamble Company, Cincinnati, OH (US)

( * ) Notice: Subject to any disclaimer, the term of this patent is extended or adjusted under 35 U.S.C. 154(b) by 101 days.

(21) Appl. No.: 18/483,709

(22) Filed: Oct. 10, 2023

(65) Prior Publication Data

US 2024/0115087 A1 Apr. 11, 2024

(51) Int. Cl.
*B65D 83/08* (2006.01)
*A47K 10/42* (2006.01)

(52) U.S. Cl.
CPC ..... *A47K 10/421* (2013.01); *B65D 83/0835* (2013.01)

(58) Field of Classification Search
CPC ..... B65D 75/5877; B65D 83/0805; B65D 83/0835; B65D 2565/386; A47K 10/421
USPC ..... 206/494, 233, 812, 817, 824; 221/33, 45
See application file for complete search history.

(56) References Cited

U.S. PATENT DOCUMENTS 5,582,294 A * 12/1996 Yamada ..... B65B 9/067 206/812
6,702,109 B1 * 3/2004 Tabuchi ..... B65D 75/5838 53/133.4
2003/0159403 A1 * 8/2003 Verespej ..... B65D 83/0805 53/471
2008/0054011 A1 3/2008 Grimard et al.
2008/0179326 A1 * 7/2008 Krauth ..... B65D 75/5872 221/154
2011/0147401 A1 * 6/2011 Rubo ..... B65D 75/5877 221/45
2014/0374432 A1 * 12/2014 Bechyne ..... B65D 83/0805 221/45
2015/0266633 A1 * 9/2015 Cameron ..... B65D 53/02 53/412
2016/0159534 A1 * 6/2016 Ujiie ..... B65D 75/5894 220/254.3

(Continued)

FOREIGN PATENT DOCUMENTS

CN 104194123 B 6/2016
EP 2554374 A1 2/2013

(Continued)

OTHER PUBLICATIONS

PCT Search Report and Written Opinion for PCT/US2023/076400 dated Feb. 2, 2024, 15 pages.

(Continued)

*Primary Examiner* — Luan K Bui
(74) *Attorney, Agent, or Firm* — Daniel S. Albrecht

(57) ABSTRACT

The present disclosure is related to packages for disposable wipes. The packages comprise a dispensing fitment formed of a first polymer composition comprising polyethylene and a flexible package body formed of a second polymer composition comprising polyethylene. The first and second polymer composition may be the same or different.

20 Claims, 5 Drawing Sheets

(56) References Cited

U.S. PATENT DOCUMENTS

| | | | | |
|---|---|---|---|---|
| 2018/0079565 | A1* | 3/2018 | Seibert | B65D 83/0805 |
| 2019/0291942 | A1 | 9/2019 | Lange et al. | |
| 2020/0046177 | A1 | 2/2020 | Simmons et al. | |
| 2021/0316978 | A1 | 10/2021 | Lyons et al. | |
| 2022/0127440 | A1 | 4/2022 | Fujino et al. | |
| 2022/0242622 | A1 | 8/2022 | Takano | |
| 2022/0242639 | A1 | 8/2022 | Meyer et al. | |

FOREIGN PATENT DOCUMENTS

| | | | |
|---|---|---|---|
| EP | 3519313 | B1 | 12/2020 |
| JP | H063713 | A | 1/1994 |
| JP | 4601785 | B2 | 10/2010 |
| JP | 2011063713 | A | 3/2011 |
| KR | 20200063508 | A | 6/2020 |

OTHER PUBLICATIONS

All Office Actions; U.S. Appl. No. 18/483,575, filed Oct. 10, 2023.
Extended EP Search Report and Opinion for 22200573.8 dated Feb. 27, 2023, 10 pages.
Recyclass, "Recyclability Evaluation Protocol for HDPE Containers Standard Laboratory Practice Recyclability Evaluation Protocol for HDPE Containers Content", online retrived from "https ://recyclass eu/wp-content/u ploads/2022/02/RecyClassRecyclability-Evaluation-Protocol-for-H D PE-containers-v.3.0-FINAL. pdf", XP093044176, Jan. 31, 2022,19 pages.
Recyclass, "Recyclability Evaluation Protocol for PE Films Standard Laboratory Practice Recyclability Evaluation Protocol for PE Films Content", online retrieved from"https://recyclass.eu/wpcontent/uploads/2022/02/RecyClassRecyclability-Evaluation-Protocol-for-PE-Films-v.3.0-FINAL.pdf", XP093044187, Jan. 31, 2022,19 pages.
Recyclass, "Recyclability Evaluation Protocol for PP Containers Standard Laboratory Practice Recyclability Evaluation Protocol for PP Containers Content", online retrieved from"https://recyclass.eu/wp-content/uploads/2022/02/RecyClassRecyclability-Evaluation-Prot", XP093044186, Jan. 31, 2022,23 pages.
Recyclass, "Recyclability Evaluation Protocol for PP Films Standard Laboratory Practice Recyclability Evaluation Protocol for PP Films Content", online retrieved from"https://recyclass.eu/wpcontent/uploads/2022/02/RecyClass-Recyclability-Evaluation-Protocol-for-PP-films_v2.0-FINAL.pdf", XP093044184, Jan. 31, 2022,19 pages.
U.S. Appl. No. 18/483,575, filed Oct. 10, 2023, to Alexander Eberhard Unger et al.

* cited by examiner

RECYCLABLE PACKAGE FOR DISPOSABLE WIPES

CROSS-REFERENCE TO RELATED APPLICATIONS

This application claims priority under 35 U.S.C. § 119 to European Patent Application Serial No. 22200573.8, filed on Oct. 10, 2022, the entire disclosure of which is hereby incorporated by reference.

FIELD

The present disclosure relates to recyclable packages for disposable wipes.

BACKGROUND

For many packaging applications polymer materials are indispensable due to their unique properties and flexibility in material design. In principle many plastics including polyethylene (PE) and polypropylene (PP) are recyclable. However, they have to be separated after consumer use and prior to recycling to obtain high quality post-consumer recycled (PCR) material, which resembles the attributes of and thus may replace virgin polymer material. The different types of polymers are identified via their near infra-red (NIR) response. For PE, many countries and/or regions further separate high-density PE (HDPE) and low-density PE (LDPE) into two recycling streams to obtain high quality recycled material. Similarly, separate recycling streams for rigid and flexible packages made of PP are envisioned or already practiced.

For packages to be labeled "recyclable", material gained from recycling the materials has to fulfill high standards mimicking the properties of virgin plastic material. The criteria are typically set by industry associations following the standards given by the legal framework of the respective country or region. In Europe, RecyClass, a cross-industry initiative of the Plastic Recyclers of Europe (PRE), works to advance plastic packaging recyclability and thus has developed a validation process to evaluate and calculate recyclable content in plastic products. Via this validation process, the percentage of packaging material, which may be used to obtain high-quality recycled material, can be determined.

Dry or wet wipes are currently sold for a variety of applications, including for use in personal cleansing in circumstances where soap, water, cloths, towels and a sink or washtub facility are unavailable or inconvenient. Wipes are also used for cleaning items other than human bodies, treating materials or surfaces, or delivering materials to a targeted area. Wipes as packaged and sold typically comprise a stack of individually cut sheets in an interleaving folding pattern, or a continuous folded stack or roll of material having perforations dividing the material into lengths that may be torn away at the perforations as individual sheets. The material of which the sheets are formed may be a nonwoven material formed of polymeric or natural fibers, or a combination thereof. The material is typically highly porous and capable of absorbing and holding a substantial fraction of its weight, or more, of a liquid composition. For wet wipes, the stack or roll may be moistened or even saturated with the liquid composition. The liquid composition may be a solution or an emulsion, or a combination thereof, and may contain one or more cleansing agents, skin care agents, preservatives (antibacterial agents) and perfumes. As such, the wipes may constitute a convenient and pleasant product useful for a variety of personal cleansing applications, such as hand wipes, child wipes, baby wipes, etc.

One way in which wipes are packaged is within a flow-wrap film package. A polymer film having a suitably low water vapor transmission rate is selected and used to form stock package material. Wipes stacks are formed and conveyed to a flow wrapping machine, which wraps the stock package material about each stack and forms seams in the flow-wrap film material to join it to itself and seal it about the stack. Thereby a moisture-retaining package of wet wipes, a moisture-detaining package of dry wipes respectively, is obtained that is sufficient to retain the moisture content, keep the wipes dry respectively, from the time of manufacture to the time of use. Packages for wipes typically include some form of dispenser or fitment to facilitate practical dispensing. Once the wipes are removed, the package including the dispenser or fitment may be disposed of.

Polymer materials, plastics respectively, are best suited to fulfill the requirements for both the film and the dispenser or fitment. The described flexible films typically comprise laminates of different polymer materials including PE, while the more rigid dispenser or fitment is typically made of PP or PP blends. As the dispenser or fitment is adhered to the flexible film in wipes packages via a dispensing fitment adhesive, the different kinds of polymer materials cannot be separated prior to recycling without substantial effort and/or involving the consumer.

Given the ever-pressing need to minimize the environmental footprint, there is still need for package designs, in particular for applications in wipes packages comprising a fitment, which enable improved recyclability and returning high quality recyclates, while maintaining its user-friendly functionality. In particular, there remains the need to provide wipes packages comprising a fitment, which can be recycled yielding high quality recyclates without separating the fitment from the flexible package body.

SUMMARY

Due to the packages for disposable wipes according to the invention, high recyclability yielding high quality recyclates can be achieved.

Packages for disposable wipes are provided. The package comprises a dispensing fitment, which is formed of a first polymer composition comprising polyethylene, and a flexible package body, which is formed of a second polymer composition comprising polyethylene and optionally lamination adhesives and lamination hardeners, in case the flexible package body is laminated film. The first and second polymer composition may be the same or different.

DETAILED DESCRIPTION

The following definitions may be useful in understanding the present disclosure.

"HDPE" is a thermoplastic made from the monomer ethylene with a density range of 940-980 kg/m$^3$.

"LDPE" is a thermoplastic made from the monomer ethylene with a density range of 910-940 kg/m$^3$.

"LLDPE" is a substantially linear polyethylene made via copolymerization of monomer ethylene with longer-chain alpha-olefin monomers via Ziegler-Natta or metallocene catalysts (mLLDPE).

"Polymer composition" is used herein as a composition comprising at least one type of polymer and optionally additives.

"Post-consumer recycled (PCR) material" is waste created by consumers after a product has reached the end of its use. This material is diverted from the landfill or recuperated in recollection systems and utilized in the production of other commodities.

"Post-industry recycled (PIR) material" relates to reintroduction of pre-consumer waste generated in a manufacturing process back into an upstream manufacturing process.

"Resin pellets", as used herein, are small granules of polymeric material, which may have the shape of a cylinder or a disc. The size of the resin pellets may range from 2 mm to 5 mm with a diameter of a few mm.

"Sealed" refers herein to a package having an interior that is inaccessible until the package is ruptured. It also refers to two or more layers of a polymeric film which are overlaying each other and are joined to each other, e.g., to form side seams of a flexible package. In the side seam, the layers of polymeric film are sealed such that they cannot be separated without rupturing or tearing the polymeric film.

"Virgin polymeric material" as used herein, means the polymeric material produced directly from the petrochemical or plant based feed-stock, such as natural gas or crude oil or sugar cane, which has never been used or processed before.

"Machine direction" (MD) is used herein to refer to the direction of material flow through a process. In addition, relative placement and movement of material can be described as flowing in the machine direction through a process from upstream in the process to downstream in the process.

"Cross direction" (CD) is used herein to refer to a direction that is not parallel with, and usually perpendicular to, the machine direction.

"Mono-material film" refers to a film, wherein the film and each layer of the film comprise at least 80% by weight of one type of polymer, such as polyethylene. In particular, each layer of the film consists of one type of polymer, such as polyethylene, and optionally additives and the film consists of one type of polymer, such as polyethylene, optionally additives and optionally lamination adhesives and lamination hardeners for laminated multi-layer mono-material films.

Figure 1:
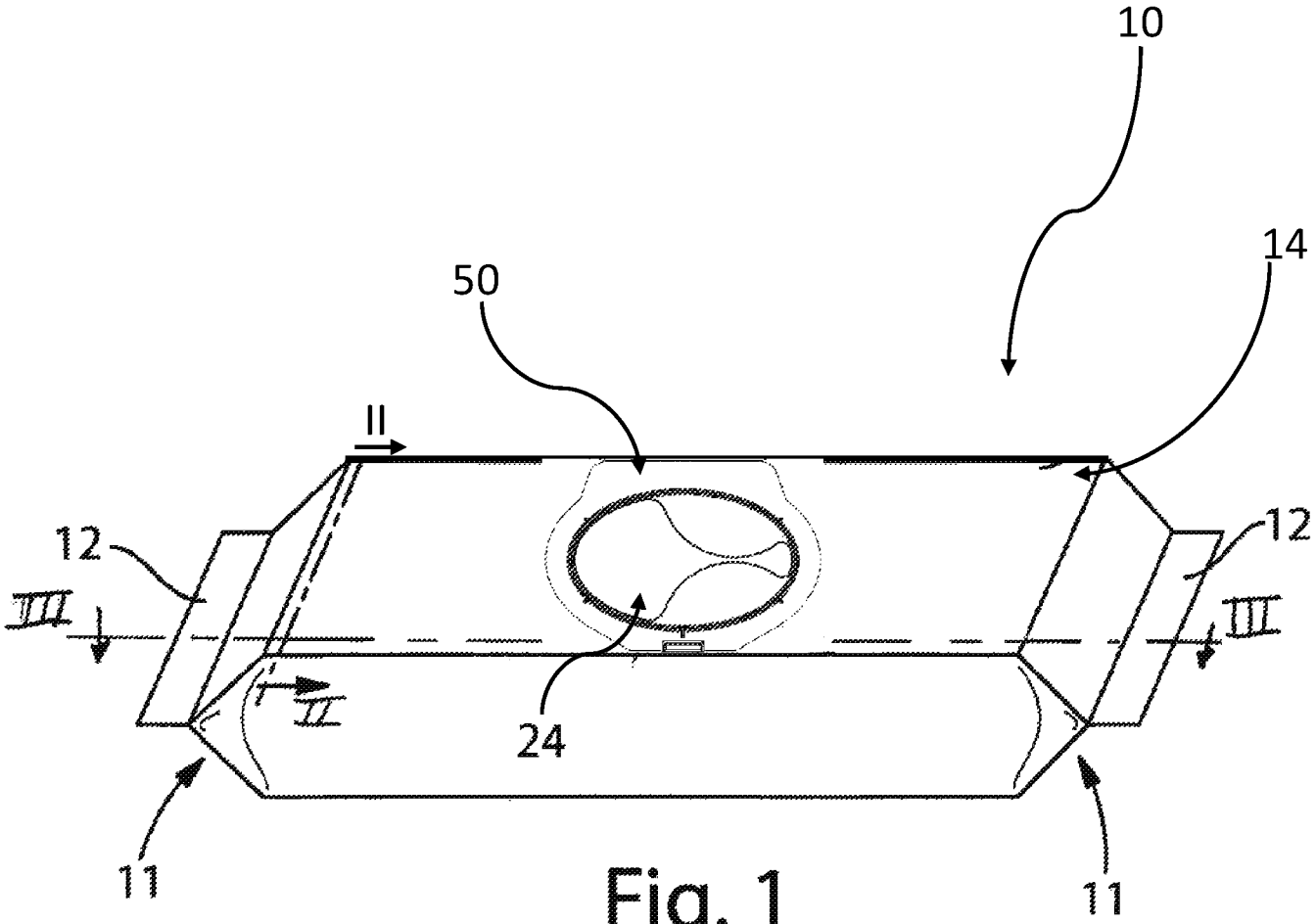
FIG. 1 is a perspective view of a package for disposable wipes comprising a fitment as described herein.

The present invention is generally directed to packages for disposable wipes 10. FIG. 1 depicts a package for disposable wipes 10. The package 10 may encompass a stacked supply of wipes 100 formed of a suitable substrate of nonwoven web material. The substrate of wipes 100 may be made of cellulosic material. In particular, substrate of wipes 100 may be made of cellulosic material and be recyclable, e.g., in accordance with UNI 11743:2019. The packages 10 of the present invention are preferably configured for dispensing stacks of folded wipes and not a convolutely wound series of wipes. While the wipes may be connected and separated, for example via perforations, the stacked wipes are preferably discrete and not connected to one another. Instead, they are simply stacked on top of one another or partially nested with one another. For clarification, whenever a package is mentioned in the present application, wipes potentially contained by it do not form part of the package or contribute to the weight of the package unless explicitly stated otherwise, as packages to be recycled should be empty and thus the application concerns the package as such.

The wipes 100 encased by the package for disposable wipes 10 may be moistened with a liquid composition by the manufacturer or packager, or alternatively moistened by the end user after purchasing the package of substrates. A typical liquid composition comprises an aqueous lotion composition. The lotion compositions may contain at least 80%, preferably at least 85%, more preferably at least 90%, even more preferably at least 95%, or even at least 98.5% by weight of water.

Flexible Package Body

Figure 2:
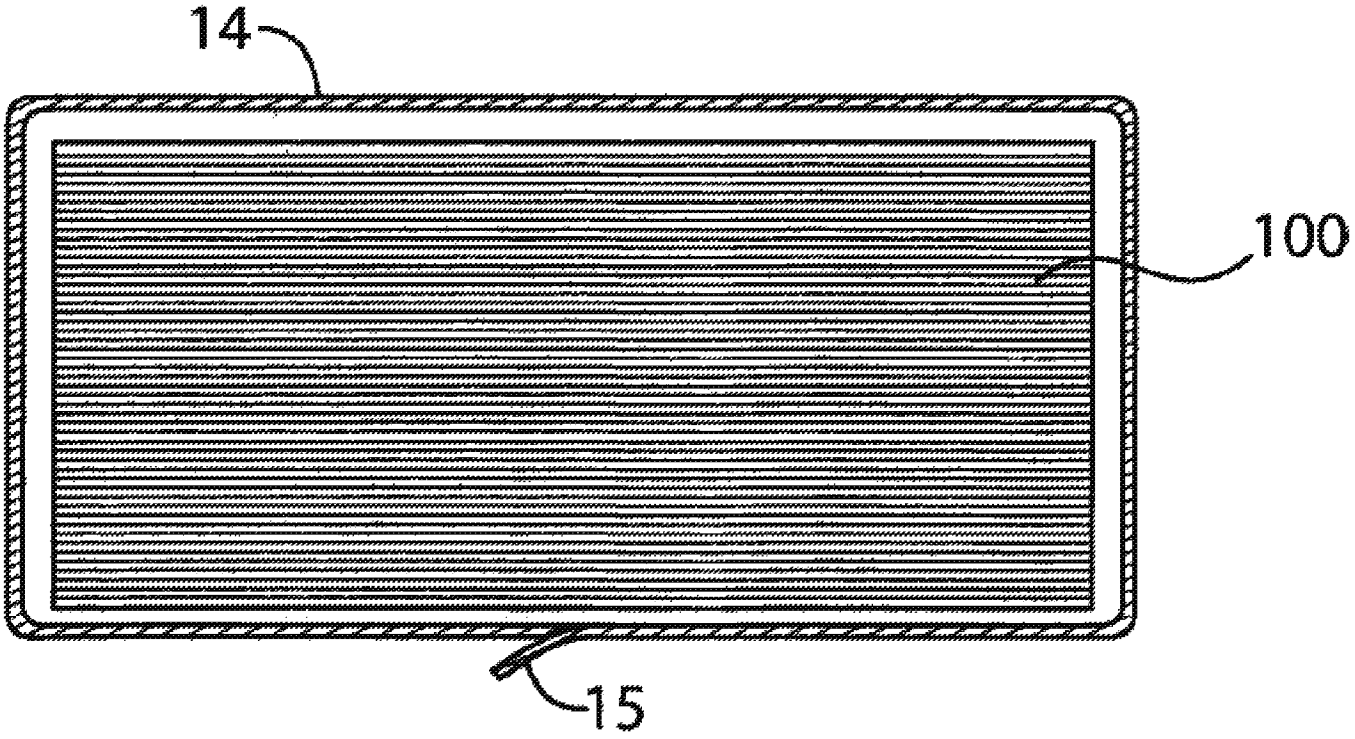
FIG. 2 is a cross-sectional view taken through II-II of the flexible package body encasing wipes, dispensing fitment not included.
Figure 3:
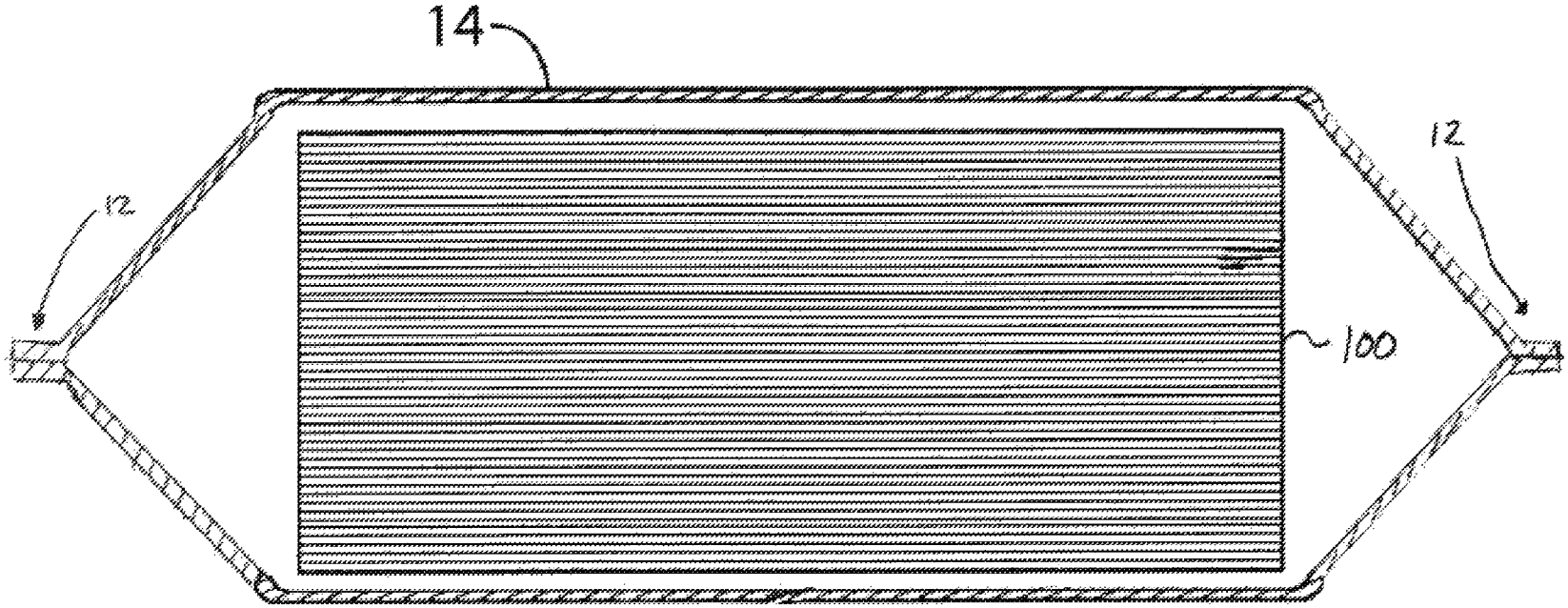
FIG. 3 is a cross-sectional view taken through III-III of the flexible package body encasing wipes, dispensing fitment not included.

The package for disposable wipes 10 comprises a flexible package body 14 suitable to encase a stack of wipes 100. FIGS. 2 and 3 depict a flexible package body 14 encasing a stack of wipes 100. The flexible package body 14 is formed of a second polymer composition. Optionally lamination adhesives and lamination hardeners may be present. In particular, the flexible package body 14 may be formed of a film consisting of one or more layers formed of the second polymer composition. For example, two or more layers may be coextruded or laminated to form one film. The two or more layers may comprise polymer subcompositions, which may be the same or different from another. All polymer subcompositions together form the second polymer composition. For example, a first layer and a second layer may be formed of the second polymer composition consisting of polyethylene (PE), and optionally additives. So, the first and second layer both consist of PE and optionally additives, but the polymer subcompositions consisting of PE of the first layer may exemplarily have a higher density than the polymer subcompositions consisting of PE of the second layer. The first and second layer may be co-extruded or may form a laminate with a separate layer of lamination adhesive positioned between the first and second layer. There may be no more than 10, no more than 5, no more than 3 or even just one subcomposition forming the second polymer composition.

The second polymer composition may comprise polyethylene (PE). The second polymer composition may comprise at least 70%, preferably at least 80%, more preferably at least 90%, even more preferably at least 95% or even at least 98% of polyethylene by weight of the second polymer composition. PE may be the only polymer present in the second polymer composition.

The PE comprised by the second polymer composition may be selected from the group consisting of high-density polyethylene (HDPE), low-density polyethylene (LDPE), linear low-density polyethylene (LLDPE) and any combinations thereof. In particular, the PE comprised by the second polymer composition may be a combination of HDPE and LDPE or a combination of LDPE and LLDPE. In one example, the PE comprised by the second polymer composition may be LDPE. In one particular example, the second polymer composition may comprise or consist of LDPE as polymer optionally in combination with additives.

The second polymer composition may comprise a LDPE with a melt-flow index (MFI) from 0.25 g/10 min to 3.00 g/10 min, preferably from 0.50 g/10 min to 2.50 g/10 min, more preferably from 0.60 g/10 min to 2.00 g/10 min, even more preferably from 0.65 g/10 min to 1.00 g/10 min or even from 0.70 g/10 min to 0.90 g/10 min measured according to DIN EN ISO 1133/ISO 1872-2 (190° C., 2.16 kg) for the LDPE resin. By choosing such a MFI, recyclability in the LDPE and HDPE stream can be ensured.

The second polymer composition may comprise a LLDPE with a MFI from 0.50 g/10 min to 10.00 g/10 min, preferably from 0.60 g/10 min to 5.00 g/10 min, more preferably from 0.70 g/10 min to 4.00 g/10 min, even more preferably from 0.80 g/10 min to 3.00 g/10 min or even from 1.00 g/10 min to 2.50 g/10 min measured according to DIN EN ISO 1133/ISO 1872-2 (190° C., 2.16 kg). By choosing such a MFI, recyclability in the LDPE and HDPE stream can be ensured.

The flexible package body 14 may comprise or consist of a mono-material film selected from the group consisting of laminated multi-layer material, co-extruded multi-layer material and single layer material. In particular, each layer consists of the same polymer or of the same polymer combination, for example each layer consists of PE—i.e. HDPE, LDPE, LLDPE, or any combinations thereof—as polymer optionally in combination with additives. In other words, additives may vary from layer to layer while the base polymer may be the same for each layer. Exemplarily, the flexible package body 14 may comprise a mono-material film comprising at least an inner sealing layer and an outer surface layer. The inner sealing layer faces the inside of the package, while the outer surface layer faces the consumer. The inner sealing layer and/or the outer surface layer may consist of PE as polymer optionally in combination with additives. In particular, the inner sealing layer may comprise or consist of mLLDPE, in particular C6-C8-side-branched mLLDPE, optionally in combination with additives. Such materials allow for precise adjustment of the sealing window. Exemplarily, a C6-side-branched mLLDPE may be obtained by co-polymerization of ethylene with 1-octen in presence of a metallocene catalyst. In particular, the outer surface layer may comprise or consist of LDPE and/or HDPE, in particular HDPE, optionally in combination with additives. The outer surface layer may be printed and/or may be modified to exhibit sensorial experiences delighting consumer. In one example, the mono-material film may be a laminated multi-layer material, wherein the film consists of PE as polymer optionally in combination with additives; and lamination adhesives and lamination hardeners. The outer surface layer may exemplarily be modified via micro-embossing to a soft, paper- or cloth-like touch. The mono-material film may have a thickness of from 40 μm to 100 μm, preferably from 50 μm to 80 μm, more preferably from 60 μm to 70 μm as measured according to ISO 4593:1993. In one example, the mono-material film may have a thickness of from 40 μm to 100 μm, preferably from 50 μm to 80 μm, more preferably from 60 μm to 70 μm and comprise at least an inner sealing layer and an outer surface layer, wherein the thickness of the inner sealing layer is larger than the thickness of the outer surface layer. In particular, the inner sealing layer may have a thickness of from 20 μm to 90 μm or from 30 μm to 60 μm and the outer surface layer may have a thickness of from 10 μm to 80 μm or from 20 μm to 40 μm as measured according to ISO 4593:1993.

Lamination adhesives and lamination hardeners and ways to select these for different film types are known to the person skilled in the art. Exemplarily, aliphatic urethane acrylates or polyurethane based lamination adhesives are commonly used. Aliphatic urethane acrylates have good adhesion to most films and are non-yellowing. Preferably, the lamination adhesive may comprise or consist of polyolefin- or polyolefin-copolymer based adhesives. Exemplary polyolefin or polyolefin-copolymer based adhesives are maleic anhydride grafted polypropylene, maleic anhydride grafted polyethylene, ethylene-vinyl acetate-copolymers, ethylene-acrylic acid-copolymers, ethylene-butylate-copolymers. In particular, the lamination adhesive may comprise or consist of an adhesive, which is qualified for the PE flexible stream, the HDPE tube or bottle stream, the PP container stream or the PP flexible stream by RecyClass. Lamination adhesives qualified for the PE flexible stream exemplarily include Loctite Liofol LA7102 RE+Loctite Liofol LA-6902 RE from Henkel, Loctite Liofol LA-7818 RE+Loctite Liofol LA-6231 RE from Henkel. Both adhesives from Henkel are two components solvent-free laminating adhesives. SF10M is a solvent free two component polyurethane-cross-linking adhesive.

Further the flexible package body 14 exhibits a near infra-red (NIR) response, which is substantially the same on any surface. In particular, the inner and outer surface of the flexible package body 14 may exhibit substantially the same NIR response. Further, the flexible package body 14 may exhibit two predominant peaks at 1728 nm and 1764 nm, whereas the peak at 1728 nm exhibits a higher absorbance. By this, sorting into the right recycling stream is ensured, even if the flexible package body 14 is damaged and/or torn and/or the inner surface is scanned by the NIR signal through the dispensing opening.

Further, the second polymer composition may comprise recycled resin, in particular recycled PE resin. The recycled resin may be obtained from PCR and/or PIR material. By this the environmental footprint of the packages 10 according to the present invention may be further reduced.

Further, the second polymer composition may comprise bio-based resin, in particular bio-based PE resin. By this the environmental footprint of the packages 10 according to the present invention may be further reduced.

The second polymer composition may consist of PE optionally in combination with additives. In particular, no other polymer than PE may be present in the second polymer composition. In some examples, the second polymer composition may comprise or consist of PE and $TiO_2$ optionally in combination with pigments.

Non-limiting examples of classes of additives include antioxidants, colorants, nanoparticles, antistatic agents, processing aids, slip agents such as Eurucamides or waxes, flame retardants, fillers, and combinations thereof. Fillers exemplarily comprise

- glass including fibers, spheres, hollow spheres, flakes, MgO, $SiO_2$, $Sb_2O_3$ or $Al_2O_3$ glasses;
- inorganic hydroxides such as $Al(OH)_3$, $Mg(OH)_2$;
- silicates such as talc, mica, kaolin, wollastonite, montmorillonite, nanoclays, feldspar;
- organics and
- carbon such as graphite, carbon fibers, graphite fibers and flakes, carbon nanotubes, carbon black.

Colorants may be pigments and/or opacifiers. Opacifiers may be selected from $TiO_2$, $CaCO_3$, Carbon black, $ZnO_2$, $BaSO_4$, and organic dyes. In particular, $TiO_2$ may be used as additive. $TiO_2$ may provide the flexible package body 14 and/or the fitment with an opaque and/or white appearance.

The flexible package body 14 may comprise or consist of a mono-material film, which is qualified for the PE flexible stream or the PP flexible stream by RecyClass. Films qualified for the PE flexible stream exemplarily include EcoLam from Constantia Flexibles, VO+LLDPE from VOID Technologies, EcoLam is PE barrier laminate for reel-fed film and pouch with a functional barrier made by combining EVOH and Al metallization, which are equal to 1.8% of the total film weight. VO+LLDPE is a cavitated PE film made with a blend of metallocene LLDPE and VO+masterbatch.

Figure 4:
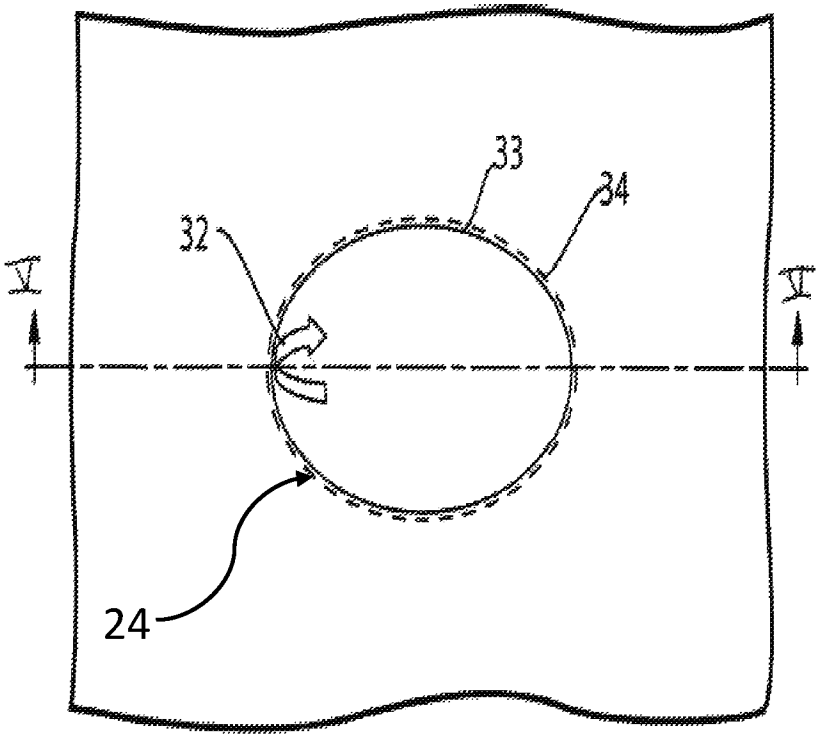
FIG. 4 shows a view from above of the package for disposable wipes incorporating a perforated opening through which wipes may be dispensed.

The flexible package body 14 may comprise a weakened region 24 to facilitate creation of a dispensing opening upon first opening and/or use of the package of wipes. An exemplary flexible package body 14 with a weakened region 24 is shown in FIG. 4. The weakened region 24 can be defined by a line of weakness 33 created by perforation, scoring, or embossing, for example. The flexible package body 14 may comprise a weakened region 24 having a boundary defined by a discontinuous line of laser or mechanical score segments. Laser scoring may be performed using a laser light source, which may be selected by light frequency and power to penetrate the flexible packaging material to a desired depth. Under certain circumstances, a laser may be selected and/or adjusted to score through one type of material without substantially scoring through another. By way of example, the weakened region 24 may comprise laser score segments, a first indicium to highlight the location and scope of weakened region 24, and a second indicium to communicate removal of the weakened region 24 upon manipulation of the same to create the access opening. The shape characteristics of the weakened region 24 formed by the scored groove may be deemed important. It may be preferable that the shape be selected from the group consisting of circle, oval, ovaloid, ellipse, egg-shape, rounded rectangle (rectangle with rounded corners), or any shape that lacks sharp corners. Alternatively, it may be preferable that the scored groove include few or no sharp turns or corners, which can have the effect of localizing stresses that can promote tear propagation that strays beyond or outside of the groove. Thus, it may be preferred that the scored groove does not include any curve having a radius less than 5 mm along any portion thereof. A circular, oval or elliptical shape may be more preferred, and an oval or elliptical shape most preferred. Additionally, it may be preferred that the selected shape have an aspect ratio of greatest dimension to smallest dimension not exceeding 4.0, more preferably not exceeding 3.0, more preferably not exceeding 2.5, and still more preferably not exceeding 2.0. This may help ensure that any curves in the scored outline are not so sharp as to concentrate tearing stresses to an extent that promotes propagation of tears that stray beyond or outside the scored groove. One or more of these characteristics may be important to reduce the possibility that a tear, initiated by the consumer attempting to create an access opening, will propagate outside or beyond the scored groove, resulting in a misshapen, unsightly opening, compromising the moisture-retaining functionality of the package, or simply frustrating the consumer.

The dispensing fitment may be situated over the weakened region 24. Further, the dispensing fitment may cover the weakened region 24. By this the dispensing opening can be covered by the fitment to prevent that—for wet wipes—the wipes dry out and/or contaminations and/or atmospheric moisture reach the wipes after the opening is created.

Opening Label

The flexible package body 14 may comprise an opening label 34 covering the weakened region 24 and/or a line of weakness 33. In FIG. 4, showing such a flexible package body 14 with a weakened region 24, the minimum dimension of such an opening label 34 is indicated by the dashed line. Such an opening label 34 can reduce moisture loss through the weakened region 24 and/or the line of weakness 33. By removing the opening label, the weakened region 24 or line of weakness 33 may be manipulated forming a dispensing opening. Alternatively, the flexible package body 14 may comprise a dispensing opening, which is covered by an opening label 34. The opening label 34 may be positioned to be removable through the opened dispensing fitment 50. Further the opening label 34 may be sized to be large enough to cover the weakened region 24, a line of weakness 33 and/or dispensing opening, but to be smaller than the opening of the dispensing fitment 50. The opening label 34 may optionally function as indicium to indicate the location of the weakened region 24. Further, the opening label 34 may comprise an indicium 32 to instruct a consumer how to manipulate the same to create an opening to the contained wipes.

The opening label 34 may be at least partially attached to the flexible package body 14 via an opening label 34 adhesive. In particular, the opening label 34 may be at least partially attached to the weakened region 24 via an opening label 34 adhesive. In particular, the opening label 34 adhesive may comprise a polymer selected from the polyolefin group. By employing such an opening label 34 adhesive, adhesive residues remaining on the flexible package body 14 after removal of the opening label 34 will have less impact on the quality of the recycled material compared with conventional adhesives such as polyurethane based cross-linked adhesives or acrylic based adhesives. Typically, such an opening label 34 is dispensed separately to the packages 10 according to the invention after creating the opening. Nevertheless, the label may be still attached to the package 10 when recycled. Thus, the opening label 34 may be recyclable in the same recycling stream as the packages according to the invention. The label may be formed of the second polymer composition. In particular, the opening label 34 may be made of the same material as the flexible package body 14.

Flexible Package Body Process

The flexible package body 14 material may be unwound from a stock roll and passed in a longitudinal/machine direction into a flow-wrap machine, along with individual wipes stacks. The flow-wrap machine may be configured so as to wrap the packaging material stock longitudinally about each incoming stack, join the packaging material along its longitudinal edges to form a sealed fin seam 15 and a sleeve-like structure about the stack, optionally tuck the packaging material at the ends to form tucks 11 or gussets, and then crimp, seal and cut the packaging material between each stack, forming individual packages of wipes having end seams 12. Sealing may be achieved via heat sealing, ultrasonic sealing or cold-pressure welding. In particular, sealing may be achieved via heat sealing. Consequently, the flexible package body 14 may comprise or consist of a heat sealable film. All heat sealable films have a window within which sealing may occur, i.e. in which the sealing layer becomes partially molten. For films with a rather narrow heat sealing window, temperature control during the heat sealing process is challenging for equipment and process control. Consequently, the flexible package body 14 may comprise or consist of a heat sealable film with a sealing window of at least 20° C., preferably of at least 25° C., more preferably of at least 30° C., even more preferably of at least 35° C. or even 40° C. according to the Sealing Window Test described herein. Such sealing windows may be achieved by employing laminated or co-extruded multi-layer films comprising a sealing layer. The sealing layer may comprise or consist of PE, ethylene co-polymers and combinations thereof optionally in combination with additives. The sealing layer may comprise or consist of mLLDPE, in particular $C_6$-$C_8$-side-branched mLLDPE, optionally in combination with additives. Such materials allow for precise adjustment of the sealing window. The flexible package body 14 may be subject to subsequent custom industrial printing and converting processes used on flexible films.

In some examples, the flow-rap machine may be operated at a line speed of at least 90 pieces per minute, preferably at a line speed of at least 100 pieces per minute, more preferably at a line speed of at least 110 pieces per minute or even at a line speed of at least 120 pieces per minute. Typically, the line speed does not exceed 200 pieces per minute. Thus, a good balance between speed of production and quality is ensured.

The dispensing fitment 50 may be attached via a dispensing fitment adhesive disposed between the dispensing fitment 50 and the flexible package body 14. The dispensing fitment 50 may be attached to the flexible package body 14 material prior to or after the flow-wrap machine.

The optional opening label 34 may be attached via an opening label adhesive to the flexible package body 14. The opening label 34 may be made from inline or offline adhesive coating on polyolefin facestock, preferably a facestock of the flexible package body 14 material, with optional subsequent custom industrial printing and converting processes used on flexible films.

Other known methods of manufacturing flexible packages may be employed to make the packages 10 described and claimed herein.

Dispensing Fitment

Figure 5:
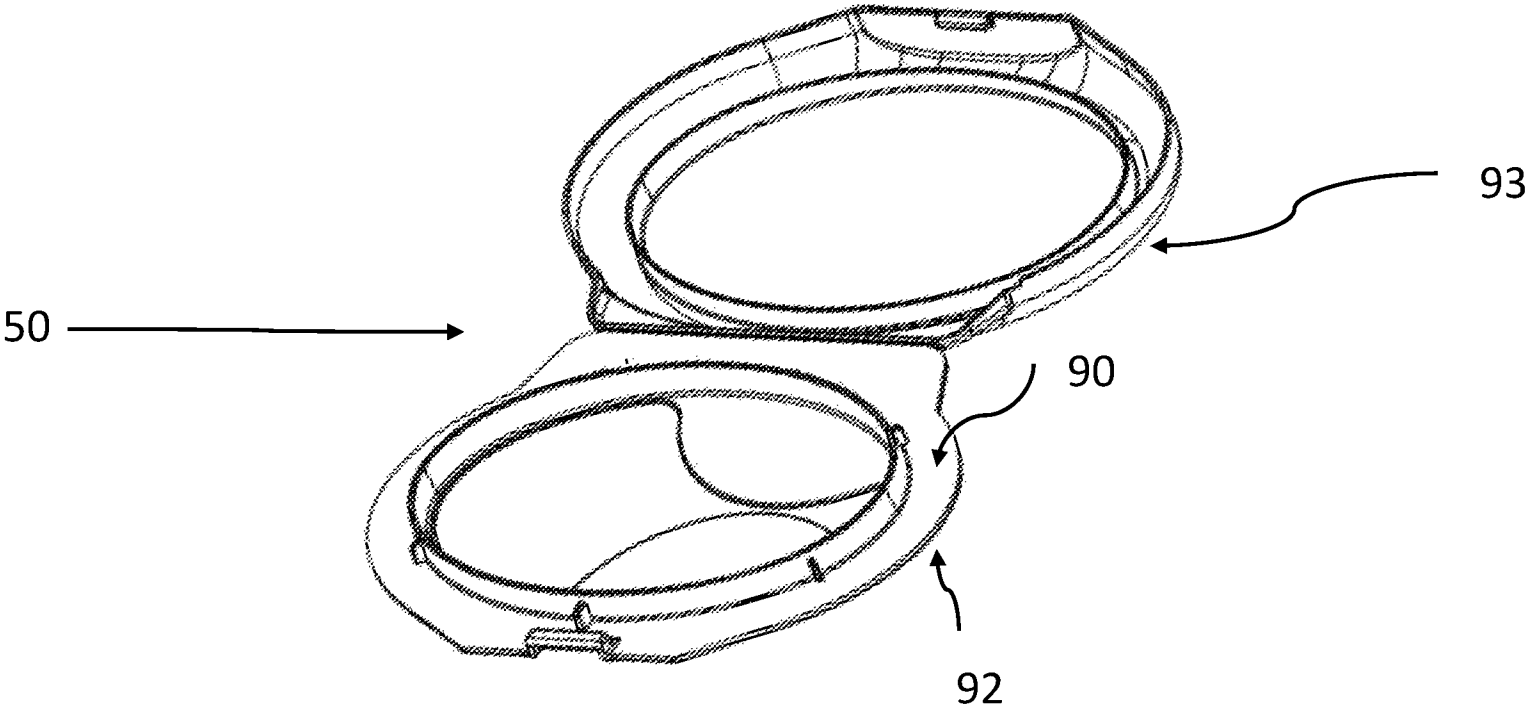
FIG. 5 is a perspective view of a dispensing fitment including a lid.

The package for disposable wipes 10 further comprises a rigid dispensing fitment 50 formed of a first polymer composition. FIG. 5 shows an exemplary dispensing fitment 50. The dispensing fitment 50 may comprise a frame for securing to the flexible package body 14 via a dispensing fitment adhesive. The frame may comprise a rim and an internal wall defining an opening through which wipes may be dispensed. The opening may comprise one or more orifices. The orifice enables users to insert their fingers, or one finger and a thumb, to create the dispensing opening in the flexible package body 14 and then to withdraw wipes from within the flexible package body 14. The opening may further occupy between about 40% and about 95% of the area within the rim. The dispensing fitment 50 further comprises a lid 93, hingedly connected to the frame to enable the opening to the wipes packaging to be closed. One or both of the lid 93 and frame may optionally be provided with lip, rim, groove, gasket, etc., cooperating sealing features such that, when the lid 93 is in a closed position, the cooperating sealing features of lid 93 and/or frame are in close proximity or effective contact with the other of the lid 93 and/or frame about the perimeter of the lid 93, so as to retard the passage of moisture between the lid 93 and the base.

The first polymer composition may comprise polyethylene (PE). The first polymer composition may comprise at least 70%, preferably at least 80%, more preferably at least 90%, even more preferably at least 95% or even at least 98% of PE by weight of the first polymer composition. PE may be the only polymer present in the first polymer composition.

The PE comprised by the first polymer composition may be selected from the group consisting of high-density polyethylene (HDPE), low-density polyethylene (LDPE), linear low-density polyethylene (LLDPE) and any combinations thereof. In particular, the PE comprised by the first polymer composition may be a combination of HDPE and LDPE. The first polymer composition may comprise at least 50% HDPE by weight of the first polymer composition. In particular, the first polymer composition may comprise from 50% to 70%, preferably from 55% to 65% of HDPE and from 30% to 50%, preferably from 35% to 45% LDPE by weight of first polymer composition. By this sufficient rigidity of the material is ensured.

In one example, the first polymer composition may comprise from 20% to 80%, preferably from 40% to 60% HDPE by weight of the first polymer composition. These forms are beneficial for the package 10 to be qualified for the HDPE recycling stream. In an alternative example, the first polymer composition may comprise from 20% to 80%, preferably from 40 to 60% LDPE by weight of the first polymer composition. These forms are beneficial for the package 10 to be qualified for the LDPE recycling stream.

The first polymer composition may comprise a HDPE with a melt-flow index (MFI) from 0.10 g/10 min to 80.00 g/10 min, preferably from 0.15 g/10 min to 70.00 g/10 min, more preferably from 0.20 g/10 min to 50.00 g/10 min, even more preferably from 0.25 g/10 min to 10.00 g/10 min or even from 0.30 g/10 min to 1.00 g/10 min measured according to DIN EN ISO 1133/ISO 1872-2 (190° C., 2.16 kg) for the HDPE resin. By choosing such MFIs, recyclability in the HDPE and/or LDPE stream (requiring lower MFIs) and the processibility in the dispensing fitment manufacturing process, in particular for injection molding processes, (requiring higher MFIs) are balanced. The HDPE comprised by the first polymer composition may further have a density from 0.940 $kg/m^3$ to 0.970 $kg/m^3$, preferably from 0.945 $kg/m^3$ to 0.965 $kg/m^3$; more preferably from 0.950 $kg/m^3$ to 0.960 $kg/m^3$ measured according to DIN EN 15344 (B) for the HDPE resin. By choosing such densities, recyclability in the LDPE stream (requiring lower densities) and the rigidity of the dispensing fitment (requiring higher densities) are balanced.

The first polymer composition may exhibit a melt-flow index (MFI) from 1.00 g/10 min to 80.00 g/10 min, preferably from 5.00 g/10 min to 70.00 g/10 min, more preferably from 10.00 g/10 min to 50.00 g/10 min, even more preferably from 15.00 g/10 min to 40.00 g/10 min or even from 20.00 g/10 min to 30.00 g/10 min measured according to DIN EN ISO 1133/ISO 1872-2 (190° C., 2.16 kg). By choosing such MFIs, recyclability in the HDPE and/or LDPE stream (requiring lower MFIs) and the processibility in the dispensing fitment manufacturing process, in particular for injection molding processes, (requiring higher MFIs) are balanced. Further, the first polymer composition may exhibit a flexural modulus from 800 MPa to 1800 MPa, preferably from 900 MPa to 1600 MPa, more preferably from 1000 MPa to 1500 MPa, even more preferably from 1050 MPa to 1400 MPa or even from 1100 MPa to 1300 MPa according to ASTM D790. By choosing such flexural modulus, recyclability in the HDPE and/or LDPE stream, in particular the LDPE stream, and the processibility in the dispensing fitment manufacturing process, in particular for injection molding processes are balanced. In particular, the combination of such MFI and flexural modulus of the first polymer composition balance recyclability in the HDPE and/or LDPE stream and processibility.

In one example, the first polymer composition may comprise a first PE resin and a second PE resin, which is different from the first PE resin. The first polymer composition may comprise a first PE resin with a (MFI) from 30.00 g/10 min to 80.00 g/10 min, preferably from 35.00 g/10 min to 75.00 g/10 min, more preferably from 40.00 g/10 min to 70.00 g/10 min measured according to DIN EN ISO 1133/ISO 1872-2 (190° C., 2.16 kg). The first polymer composition may comprise the first PE resin from 20% to 80%, preferably from 40% to 60%, by weight of the first polymer composition. The second PE resin may exhibit a melt-flow index (MFI) from 1.00 g/10 min to 30.00 g/10 min, preferably from 2.00 g/10 min to 20.00 g/10 min, more preferably from 5.00 g/10 min to 10.00 g/10 min measured according to DIN EN ISO 1133/ISO 1872-2 (190° C., 2.16 kg). The first polymer composition may comprise the second PE resin from 20% to 80%, preferably from 40% to 60%, by weight of the first polymer composition. The first PE resin may be a LDPE or HDPE resin and the second PE resin may be a HDPE resin. By choosing such MFIs and combination of two PE resins, recyclability in the HDPE and/or LDPE stream (requiring lower MFIs) and the processibility in the dispensing fitment manufacturing process, in particular for injection molding processes, (requiring higher MFIs) can be balanced.

In particular, the first polymer composition may comprise two or more HDPE resins. The first polymer composition may comprise at least 50%, at least 60%, at least 70%, at least 80%, at least 90%, at least 95%, at least 98% or even 100% of HDPE by weight of the first polymer composition. The first polymer composition may comprise at least 50%, at least 60%, at least 70%, at least 80%, at least 90%, at least 95%, at least 98% or even 100% of HDPE by weight of the first polymer composition and comprise two or more HDPE resins. The first polymer composition may comprise a first HDPE resin and a second HDPE resin. The first HDPE resin and a second HDPE resin may be different. The first polymer composition may comprise from 20% to 80%, from 25% to 75%, from 30% to 70% or from 40% to 60% of the first HDPE resin by weight of the first polymer composition. The first polymer composition may comprise from 20% to 80%, from 25% to 75%, from 30% to 70% or from 40% to 60% of the first HDPE resin by weight of the second polymer composition. The first HDPE resin may exhibit a melt-flow index (MFI) from 30.00 g/10 min to 80.00 g/10 min, preferably from 35.00 g/10 min to 75.00 g/10 min, more preferably from 40.00 g/10 min to 70.00 g/10 min measured according to DIN EN ISO 1133/ISO 1872-2 (190° C., 2.16 kg). The second HDPE resin may exhibit a melt-flow index (MFI) from 1.00 g/10 min to 30.00 g/10 min, preferably from 2.00 g/10 min to 20.00 g/10 min, more preferably from 5.00 g/10 min to 10.00 g/10 min measured according to DIN EN ISO 1133/ISO 1872-2 (190° C., 2.16 kg). The first HDPE resin may exhibit a MFI from 100% to 1500%, preferably from 200% to 1250%, more preferably from 300% to 1000% or even from 400% to 900% of the MFI of the second HDPE resin according to DIN EN ISO 1133/ISO 1872-2 (190° C., 2.16 kg). The first HDPE resin may exhibit flexural modulus from 600 MPa to 1500 MPa, preferably from 800 MPa to 1300 MPa, more preferably from 900 MPa to 1250 MPa or even from 1000 MPa to 1100 MPa according to ASTM D790. The second HDPE resin may exhibit flexural modulus from 1000 MPa to 2000 MPa, preferably from 1100 MPa to 1800 MPa, more preferably from 1200 MPa to 1600 MPa, or even from 1300 MPa to 1500 MPa according to ASTM D790. The first HDPE resin may exhibit a flexural modulus from 40% to 100%, preferably from 50% to 95%, more preferably from 60% to 90% or even from 70% to 80% of the flexural modulus of the second HDPE resin according to ASTM D790. Again the combination of MFI and flexural modulus of the components of the first polymer composition has proven beneficial both for recyclability in the HDPE and/or LDPE stream and processibility. The first HDPE resin may exhibit a density from 0.940 kg/m' to 0.970 kg/m$^3$, preferably from 0.945 kg/m$^3$ to 0.965 kg/m$^3$; more preferably from 0.950 kg/m$^3$ to 0.960 kg/m$^3$ measured according to DIN EN 15344 (B). The second HDPE resin may exhibit a density from 0.940 kg/m$^3$ to 0.970 kg/m$^3$, preferably from 0.945 kg/m$^3$ to 0.965 kg/m$^3$; more preferably from 0.950 kg/m$^3$ to 0.960 kg/m$^3$ measured according to DIN EN 15344 (B).

The first polymer composition may comprise a LDPE with a melt-flow index (MFI) from 0.10 g/10 min to 90.00 g/10 min, preferably from 0.15 g/10 min to 70.00 g/10 min, more preferably from 0.20 g/10 min to 50.00 g/10 min, even more preferably from 0.25 g/10 min to 10.00 g/10 min or even from 0.30 g/10 min to 1.00 g/10 min measured according to DIN EN ISO 1133/ISO 1872-2 (190° C., 2.16 kg) for the LDPE resin. By choosing such MFIs, recyclability in the HDPE and/or LDPE stream (requiring lower MFIs) and the processibility in the dispensing fitment manufacturing process, in particular for injection molding processes, (requiring higher MFIs) are balanced. The LDPE comprised by the first polymer composition may further have a density from 0.910 kg/m$^3$ to 0.935 kg/m$^3$, preferably from 0.915 kg/m$^3$ to 0.930 kg/m$^3$; more preferably from 0.920 kg/m$^3$ to 0.925 kg/m$^3$ measured according to DIN EN 15344 (B) for the LDPE resin. By choosing such densities, recyclability in the LDPE stream (requiring lower densities) and the rigidity of the dispensing fitment (requiring higher densities) are balanced.

The first polymer composition may comprise a LLDPE with a melt-flow index (MFI) from 0.10 g/10 min to 150.00 g/10 min, preferably from 0.15 g/10 min to 100.00 g/10 min, more preferably from 0.20 g/10 min to 85.00 g/10 min, even more preferably from 0.25 g/10 min to 10.00 g/10 min or even from 0.30 g/10 min to 1.00 g/10 min measured according to DIN EN ISO 1133/ISO 1872-2 (190° C., 2.16 kg) for the LLDPE resin. By choosing such MFIs, recyclability in the HDPE and/or LDPE stream (requiring lower MFIs) and the processibility in the dispensing fitment manufacturing process, in particular for injection molding processes, (requiring higher MFIs) are balanced. The LLDPE comprised by the first polymer composition may further have a density from 0.910 kg/m$^3$ to 0.960 kg/m$^3$, preferably from 0.915 kg/m$^3$ to 0.950 kg/m$^3$; more preferably from 0.920 kg/m$^3$ to 0.940 kg/m$^3$ measured according to DIN EN 15344 (B) for the LLDPE resin. By choosing such densities, recyclability in the LDPE stream (requiring lower densities) and the rigidity of the dispensing fitment (requiring higher densities) are balanced.

Further, the first polymer composition may comprise recycled resin, in particular recycled PE resin. The recycled resin may be obtained from PCR and/or PIR material. By this the environmental footprint of the packages 10 according to the present invention may be further reduced.

Further, the first polymer composition may comprise bio-based resin, in particular bio-based PE resin. By this the environmental footprint of the packages 10 according to the present invention may be further reduced.

The first polymer composition may consist of PE optionally in combination with additives. In particular, no other polymer than PE may be present in the first polymer composition.

The dispensing fitment 50 may be formed via any suitable polymer forming process. In particular, the dispensing fitment 50 may be formed via an injection molding process. Providing the entire fitment in one injection molding process enables an affordable fitment that still provides the required benefits such as providing an open area through which the weakened region 24 of the flexible package body 14 may be manipulated to create a dispensing opening and wipes may be retrieved.

The dispensing fitment 50 may further comprise a dispensing fitment label. The dispensing fitment label may be a label containing information, such as commercial logos and/or product information. The dispensing fitment label may be attached to the consumer facing surface of the lid 93 of the dispensing fitment 50. The dispensing fitment label may be attached via a dispensing fitment label adhesive. The dispensing fitment label adhesive may be a hotmelt adhesive and may further be pressure sensitive. The dispensing fitment label adhesive may comprise one or more backbone polymers selected from the polyolefin group. To eliminate the adhesive and thus its potential negative impact on the quality of the recycled material, the dispensing fitment label may be an in-mold label. In particular, the dispensing fitment 50 may be formed via an injection molding process and the dispensing fitment label added to the dispensing fitment as in-mold label during the process. The dispensing fitment label may comprise PE. The dispensing fitment label may comprise at least 70%, preferably at least 80%, more preferably at least 90%, even more preferably at least 95% or even at least 98% of PE by weight of dispensing fitment label without printing inks. The dispensing fitment label may consist of PE and optionally additives. The dispensing fitment label may further be subject to custom industrial printing. The printing may be done inline or offline.

The first and second polymer composition may be the same or different. The first polymer composition may comprise a higher HDPE concentration by weight than the second polymer composition. In particular, the first polymer composition may comprise between 50% and 80%, between 55% and 75% HDPE by weight of the first polymer composition and the second polymer composition may comprise between 0% and 50%, between 0% and 40% HDPE by weight of the second polymer composition. Further, the first polymer composition may comprise between 20% and 50%, between 25% and 45% LDPE by weight of the first polymer composition and the second polymer composition may comprise between 50% and 100%, between 60%% and 98% LDPE by weight of the second polymer composition.

Further, package 10 may exhibit two predominant peaks at 1728 nm and 1764 nm in the NIR spectrum, whereas the peak at 1728 nm exhibits a higher absorbance. In other words, the NIR spectrum of the package exhibits two predominant peaks at 1728 nm and 1764 nm, whereas the peak at 1728 nm exhibits a higher absorbance, no matter at which surface, e.g. on the dispensing fitment, the inner layer or outer layer of the flexible package body, it is probed. By this, sorting into the PE recycling stream is ensured, no matter where the package 10 is probed by the NIR.

Dispensing Fitment Adhesive

The dispensing fitment 50 may be secured to the flexible package body 14 via a dispensing fitment adhesive. The dispensing fitment adhesive may be disposed between the dispensing fitment 50 and the flexible package body 14. The dispensing fitment adhesive may be a hotmelt adhesive. Hotmelt adhesives are typically made by combining one or more backbone polymers and additive components in a substantially uniform thermoplastic blend. Typical additive components include tackifiers, plasticizers, and/or waxes. Plasticizers such as mineral oil allow the hotmelt to be applied at lower temperature by reducing the viscosity of the composition. In some examples, the dispensing fitment adhesive may be pressure sensitive.

The dispensing fitment adhesive may comprise one or more backbone polymers selected from the polyolefin group. Typically, adhesives represent impurities in the recycled materials, which negatively affect the recycled material properties. In particular, state of the art dispensing fitment adhesives typically contain polyurethane, polyacrylates or bio-based starches as backbone polymer. While these adhesives may be utilized as dispensing fitment adhesive, they can negatively affect the quality of the recycled materials. By selecting the one or more backbone polymers of the dispensing fitment adhesive from the polyolefin group and thus from polymeric structures similar to the first and second polymer composition, the negative impact of the dispensing fitment adhesive in the recycled material obtained from the packages 10 according to the invention may be reduced in comparison to non-polyolefin polymers. In particular, the one or more polymers comprised by the dispensing fitment adhesive may be obtained by copolymerization of monomer ethylene or monomer propylene with a monomer linear or branched alpha-olefin. Preferably, one or more polymers comprised by the dispensing fitment adhesive may be obtained copolymerization of monomer ethylene with a monomer linear alpha-olefin, in particular a $C_2$-$C_{30}$-alpha-olefin. Linear alpha-olefins may be selected from the group consisting of ethylene, propylene, 1-butene, 1-pentene, 1-hexene, 1-heptene, 1-octene, 1-nonen, 1-decene, 1-undecene, 1-dodecene, 1-tridecene. In particular, the dispensing fitment adhesive may comprise one or more polymers obtained from copolymerization of monomer ethylene and monomer propylene or monomer 1-octene. Such a dispensing fitment adhesive may be recycled with the PE based first and second polymer composition in a PE recycling stream and yield a recycled material with properties close or even equal to virgin material. In particular, the dispensing fitment adhesive may comprise one or more polymers selected from the polyolefin group and/or obtained as described above by at least 80%, preferably 90% or even 95% of weight of the total dispensing fitment adhesive. In particular, the dispensing fitment adhesive may consist of one or more polymers selected from the polyolefin group and/or obtained as described above and additives. In other words, no other polymer then the one or more polymers selected from the polyolefin group and/or obtained as described above may be present in the dispensing fitment adhesive.

The packages for disposable wipes 10 according to the invention may comprise between 0.1% and 5.0%, preferably between 0.5% and 4.5%, more preferably between 1.0% and 4.0% by weight, even more preferably between 1.5% and 3.5% by weight, or even between 2.0% and 3.0% by weight of the total package 10 of the dispensing fitment adhesive.

In a further alternative, the dispensing fitment adhesive may be a water-based acrylic adhesives. Exemplarily, water-based acrylic adhesives may be water emulsions of vinyl acetate, vinyl acetate ethylene, or acrylic synthetic resin polymers. Water-based acrylic adhesives dissolve in water and thus may be removable when the package 10 is washed during recycling. As such, the adhesive does not form part of the recycled material and thus does not negatively affect the recyclate quality.

Recyclability

While the recycling systems for plastics vary between regions and countries, there are some common principles: plastic waste is sorted depending on the base polymers and by its density, rigidity respectively. The polymers most commonly employed in industrial applications PE, PP and polyethylene terephthalate (PET) are typically fed into separate recycling streams. In addition, there typically exists a so-called mixed-polyolefin (MPO) stream. This sorting is typically based on spectroscopic methods, most commonly via near-infrared (NIR) spectroscopy and thus the NIR signature of the different plastics.

In a second process, the waste is split according to its rigidity and density based on the ratio of weight and area. While large and light-weighted plastics are sorted into a stream for flexibles, heavy and small objects are sorted into a stream for rigids. This separation is typically done before the sorting according to the polymer type via mechanical methods such as wind sifting and ballistic separation at the recycling facility. But in some countries and regions, this sorting according to the form is aided by manual input of the consumers, before the packages are collected for recycling.

In Europe, plastic waste is first sorted into a recycling stream for flexibles and a recycling stream for rigids. Afterwards, the flexible stream is separated into three polymer streams: PP, LDPE and MPO. Accordingly, the rigid stream is also separated into three polymer streams: PP, HDPE and PET. The MPO stream can only be employed in so-called downcycling applications. The material composition of the recycled material of the MPO stream varies depending on the input material composition. Hence, it does not qualify for applications in packaging etc. where a constant material quality is essential.

State of the art designs of wipes packages comprising a fitment/dispenser challenge the European recycling systems both due to their overall composition/design and the composition/design of the individual parts, i.e. the fitment/dispenser, the flexible package body 14 and the adhesive.

In the mechanical separation process, current wipes packages are fed into both, the rigids and flexibles, streams with a ratio depending inter alia on the weight and area/size of the fitment/dispenser (e.g. whether a lid 93 of the fitment/dispenser is open or closed), the weight and area of the flexible package body 14, and the intactness of the overall package. As discussed, after being sorted into the flexibles and rigids streams, the packages are locally probed via NIR spectroscopy and then separated into the different polymer streams. As the flexible package body 14 and the fitment/dispenser are typically made of different polymer compositions with different polymers constituting the main polymer and thus defining the NIR response, the package is fed into the PP, MPO, LDPE or HDPE stream depending on the probing location. Packages or parts of packages sorted to an incorrect polymer stream lead to reduced quality and potentially quantity of the recycled materials.

The flexible package body 14 typically comprises laminates of different polymers, such as PE and PP, resulting in a) different NIR responses depending on the probing location (e.g. outer layer vs. inner layer in damaged/open packages); and b) impurities in either the PE stream due to the PP layers or in the PP stream due to the PE layers. Consequently, the quality and potentially quantity of recycled material is reduced.

Adhesives employed in state-of-the-art wipes packages are typically based on carbonyl-containing backbone polymers and thus potentially represent impurities in all of the PP or PE streams and thus reduce the quality of recycled materials. By eliminating adhesives (e.g by employing in-mold labels) or replacing them by polyolefin or even PE or PP based adhesives quality of the recycled materials can be greatly improved.

After sorting, typically at sorting plants, the sorted materials/packages are transferred to the recycling process as such, typically at recycling plants. A representative recycling process, which is mimicked by the RecyClass process, is composed of the following steps: In a first step, the bales of materials are shred into small pieces and metal parts removed (e.g. via magnetic means). This may be followed by further separation steps including another mechanical separation (e.g. air separation) and a further NIR spectroscopic separation. The material is further crushed and ground to obtain flakes, which are washed, optionally put through a flow separation and washed again. After a further optional mechanical separation, the purified polymer flakes are obtained and extruded—potentially co-extruded with virgin material—to obtain the recycled material in form of plastic granulates. In view of the described recycling process, further drawbacks of current wipes packaging designs become apparent:

- the NIR response of smaller pieces and/flakes in the recycling process may not respond to the NIR response obtained during sorting, as
  - a) the response of the inner and outer layer of the flexible package film may vary;
  - b) the probe during sorting may have been at the fitment/dispenser and during the recycling process the flexible package film may be probed or vice versa;
  - c) the adhesive may be probed after surfacing during the shredding/grinding processes;
- the smaller pieces/flakes may have a density and rigidity different than the overall package or part of package, which was qualified for the rigids or flexibles stream, e.g. due to a lowered or raised amount of rigid fitment/dispenser with regard to flexible packaging film. Hence, the smaller pieces/flakes may be discarded during the mechanical separation during the recycling process.

In both cases, the overall quantity of recycled material may be reduced, as materials discarded during recycling are typically not fed back into the sorting process.

By the provided package for disposable wipes 10 according to the invention, the drawbacks mentioned above can be overcome and a quality and quantity of recycled materials gained from recycling of the packages can be improved by ensuring compatibility with the respective polymer streams of both the flexibles and rigids.

The quality and quantity can be verified by the validation process by RecyClass. Although the process was developed according to European standards, its results are transferable to other countries and regions due to similarities in recycling systems.

Accordingly, the package for disposable wipes 10 comprising:

- a dispensing fitment 50 formed of a first polymer composition; and
- a flexible package body 14 formed of a second polymer composition; and may comprise at least 80%, preferably at least 85%, more preferably at least 90%, even more preferably at least 95% or even at least 98% by weight of the total package of one polymer type selected from the group consisting of polyethylene (PE) and polypropylene (PP). The package may exhibit a recyclability of at least 80%, preferably more at least 85%, more preferably at least 90%, even more preferably at least 95% or even at least 98% in either the HDPE stream and/or the LDPE stream; or the PP rigids stream and/or the PP flexibles stream according to the Recycling Rate Test method described herein.

PE Packages

In particular, the package for disposable wipes 10 according to the invention may comprise at least 80%, preferably at least 85%, preferably at least 85%, more preferably at least 90%, even more preferably at least 95% or even at least 98% by weight of the total package of PE.

In another aspect, the package for disposable wipes 10 according to the invention may exhibit a recyclability of at least 80%, preferably at least 85%, more preferably at least 90%, even more preferably at least 95% or even at least 98% % in the HDPE stream according to the Recycling Rate Test method set out herein.

In another aspect, the package for disposable wipes 10 according to the invention may exhibit a recyclability of at least 80%, preferably more at least 85%, more preferably at least 90%, even more preferably at least 95% or even at least 98% in the LDPE stream according to the Recycling Rate Test method set out herein.

In a further aspect, the package for disposable wipes 10 may exhibit a recyclability of at least 80%, preferably more at least 85%, more preferably at least 90%, even more preferably at least 95% or even at least 98% in both the LDPE and the HDPE stream according to the Recycling Rate Test method set out herein.

In one example, the package for disposable wipes 10 may comprise:

- a dispensing fitment 50 formed of a first polymer composition; and
- a flexible package body 14 formed of a second polymer composition;

and may comprise at least 80%, preferably at least 85%, more preferably at least 90%, even more preferably at least 95% or even at least 98% by weight of the total package of PE. Further, pellets obtained from the package 10 and comprising 100% by weight of package material ($PF_{100}$) may exhibit a bulk density of at least 500 kg/m$^3$ according to the LDPE stream test of the Recycling Rate Test method described herein. Further, pellets obtained from the package 10 and comprising 100% by weight of package material ($PF_{100}$) may exhibit a density in water of between 941 and 970 kg/m$^3$ according to the LDPE stream test of the Recycling Rate Test method described herein. For this example, pellets of $PF_{100}$ are obtained from the package 10 according to the Material preparation and Pellet preparation described in the LDPE stream test described below. The bulk density and density in water of the pellets may be adjusted by adjusting the material composition, in particular the ratio of HDPE to LDPE and the HDPE resin and LDPE resin, of the packages 10 according to the invention. Pellets of $PF_{100}$ may further exhibit a melt-flow index of between 0.2 and 0.9 g/10 min. The melt-flow index of the pellets may be adjusted by adjusting the material composition, in particular the ratio of HDPE to LDPE and the HDPE resin and/or LDPE resin, of the packages 10 according to the invention. Pellets of $PF_{100}$ may further exhibit an ash content of less than 2% by weight of the overall pellets weight and/or a moisture content of less than 0.1% by weight of the overall pellets weight and/or a volatiles content of less than 1% by weight of the overall pellets weight. The ash content may be reduced by the choice of additives for the flexible packaging body and/or fitment. The volatiles content may be reduced by the choice of HDPE resin and/or LDPE resin and the adhesive. Pellets of $PF_{100}$ may further exhibit a melt temperature of less than 140° C. and more than 100° C. The melt temperature may be adjusted by adjusting the material composition, in particular the ratio of HDPE to LDPE and the HDPE resin and/or LDPE resin. By exhibiting these properties in pellet form, the packages 10 qualify for recyclability in both the HDPE and LDPE stream.

Further, the package for disposable wipes 10 according to the invention may exhibit a weight loss of less than 15%, preferably less than 10%, more preferably less than 7%, even more preferably less than 5% or even less than 3% after 30 days according to the Moisture Weight Loss Test described herein. Preferably, the package for disposable wipes 10 according to the invention may exhibit a weight loss of less than 15%, preferably less than 10%, more preferably less than 7%, even more preferably less than 5% or even less than 3% after 90 days according to the Moisture Weight Loss Test described herein. More preferably, the package for disposable wipes 10 according to the invention may exhibit a weight loss of less than 15%, preferably less than 10%, more preferably less than 7%, even more preferably less than 5% or even less than 3% after 900 days according to the Moisture Weight Loss Test described herein.

PP Packages

Alternatively, the package for disposable wipes 10 according to the invention may comprise at least 80%, preferably at least 85%, preferably at least 85%, more preferably at least 90%, even more preferably at least 95% or even at least 98% by weight of the total package of PP.

In another alternative aspect, the package for disposable wipes 10 according to the invention may exhibit a recyclability of at least 80%, preferably more at least 85%, more preferably at least 90%, even more preferably at least 95% or even at least 98% in the PP rigids stream according to the Recycling Rate Test method set out herein.

In another alternative aspect, the package for disposable wipes 10 according to the invention may exhibit a recyclability of at least 80%, preferably more at least 85%, more preferably at least 90%, even more preferably at least 95% or even at least 98% in the PP flexibles stream according to the Recycling Rate Test method set out herein.

In a further alternative aspect, the package for disposable wipes 10 may exhibit a recyclability of at least 80%, preferably more at least 85%, more preferably at least 90%, even more preferably at least 95% or even at least 98% in both the PP flexibles and the PP rigids stream according to the Recycling Rate Test method set out herein.

In one example, the package for disposable wipes 10 may comprise:

- a dispensing fitment 50 formed of a first polymer composition; and
- a flexible package body 14 formed of a second polymer composition;

and may comprise at least 80%, preferably at least 85%, more preferably at least 90%, even more preferably at least 95% or even at least 98% by weight of the total package 10 of PP. Further, pellets comprising 100% by weight of package material ($PPF_{100}$) may exhibit a bulk density of at least 480 kg/m$^3$ according to the PP flexibles stream test of the Recycling Rate Test method described herein. Further, pellets obtained from the package 10 and comprising 100% by weight of package material ($PPF_{100}$) may exhibit a density in water of less than 950 kg/m$^3$ according to the PP flexibles stream test of the Recycling Rate Test method described herein. For this example, pellets of $PPF_{100}$ are obtained according to the Material preparation and Pellet preparation described in the PP flexibles stream test described below. The bulk density and density in water of the pellets may be adjusted by adjusting the PP material composition of the packages 10 according to the invention.

Pellets of $PPF_{100}$ may further exhibit an ash content of less than 2% by weight of the overall pellets weight and/or a moisture content of less than 0.1% by weight of the overall pellets weight. The ash content may be reduced by the choice of additives for the flexible packaging body 14 and/or fitment. Pellets of $PPF_{100}$ may further exhibit a melt temperature of less than 170° C. and more than 100° C. The melt temperature may be adjusted by adjusting the PP material composition. By exhibiting these properties in pellet form, the packages 10 qualify for recyclability in both PP flexibles and PP rigids stream.

Further, the package for disposable wipes 10 according to the invention may exhibit a weight loss of less than 15%, preferably less than 10%, more preferably less than 7%, even more preferably less than 5% or even less than 3% after 30 days according to the Moisture Weight Loss Test described herein. Preferably, the package for disposable wipes 10 according to the invention may exhibit a weight loss of less than 15%, preferably less than 10%, more preferably less than 7%, even more preferably less than 5% or even less than 3% after 90 days according to the Moisture Weight Loss Test described herein. More preferably, the package for disposable wipes 10 according to the invention may exhibit a weight loss of less than 15%, preferably less than 10%, more preferably less than 7%, even more preferably less than 5% or even less than 3% after 900 days according to the Moisture Weight Loss Test described herein.

Methods

Moisture Weight Loss Test

Packages for disposable wipes are made enclosing at least 30, preferably 50 to 60, wet wipes. An initial weight of 10 packages for disposable wipes is measured and reported to the nearest 0.01 g, separately for each package. The packages have to be marked with a unique identifier. After initial weight is recorded, the packages for disposable wipes are taken to storage. The packages for disposable wipes are placed onto a shelf, single layered, no stacking, with marked side facing up. The packages are stored at 25° C. and 60% relative humidity for 90 days.

After 30 days the weight for each package is determined again. The packages are then returned to stability storage conditions as described above. After 90 days the weight is determined again for each package.

Afterwards the weight loss is calculated for each package and reported to the nearest 0.1% by the following equation and the average of the 10 packages reported to the nearest 0.1%.

$$\text{Weight Loss (\%)} = (\text{Initial weight (g)} - \text{Current weight (g)})*100/\text{Initial weight (g)}$$

Current weight corresponds to the weight after 30 days and 90 days respectively.

The weight loss after 900 days is obtained via linear extrapolation by multiplying the moisture weight loss data after 90 days with a factor of 10.

Sealing Window Test

The sealing temperature is reduced to the point, where the seal of the flexible package body remains open. The sealing temperature is then increased in 5° C. steps until the seal is burned. For each temperature steps a sample of 30 packages (without wipes in them) is collected and marked with the respective temperature. The seals of the 30 packages are inspected for burn-marks. 20 of the 30 packages are then tested for ink leakage. An ink suitable for ink leakage testing according to ASTM F3039-15 is used. The respective pack is cut in the middle with scissors, but not split in two. The cut does not have to be exactly in the middle. Then two drops of ink are poured with a pipette into the inside of each half. If necessary, the package may be moved to get the ink to all parts of the seal. After a few seconds for the ink to run through the entire seal, the package is inspected for leaks. Leakage can occur via channels or networks. For a channel, there is ink leakage in a straight line from the inside to the outside through the entire seal. For a network, ink leakage occurs over an area. The width of occurring channels is determined via a ruler. The sealing window is determined as the sealing temperature range, for which for none of the 20 packages the seal is burned and there are either a) no channels and networks visible;

b) there are visible channels and/or networks, but no leakage from the inside to the outside of the seal occurs;

c) there is maximal one channel per package with a discreet channel width of no more than 0.5 mm, there are no networks through which leakage from the inside to the outside of the seal occurs; or d) there are no channels nor networks, but the seal is showing signs of burning.

Recycling Rate Test Method

Recyclability of the packages according to the invention is tested according to the Recycling Rate Test method, which is derived with adaptations from the well-established Recy-Class evaluation protocols (Protocol for HDPE containers Version 3.0; Protocol for PE films Version 3.0; Protocol for PP containers Version 3.0 and Protocol for PP films Version 2.0). There exist different evaluation protocols for LDPE flexibles/films, PP flexibles/films, HDPE rigids and PP rigids streams. All tests are typically also performed on a control sample. Further, the packages are co-extruded to pellets with a virgin polymer material corresponding to the control sample in a weight ratio of 25:75 and 50:50 of material obtained from packages and virgin polymer/control material. The recycled materials are evaluated for their properties, some in comparison to the control material. As anticipated by the person skilled in the art, the control material has to be chosen to best match (expected) properties of the package material such as density and melt-flow index. For a package to exhibit a recyclability in either the HDPE stream and/or the LDPE stream; or the PP rigids stream and/or the PP flexibles stream according to the Recycling Rate Test method described herein, the relative criteria of pellets and specimen made of package material or mixed package and control material have to be met for one control material selected from the tables for the respective streams.

Conditions may vary within a certain range given below for the different steps of the method. But control samples and samples from packages according to the invention have to be treated under exact the same conditions.

The PE and/or PP content by weight of the package is calculated from the PE and/or PP content of the different components of the package. If these data are not available, the PE and/or PP content of the different components can be determined via Differential Scanning calorimetry or FTIR Spectroscopic measurements as known to the person skilled in the art. For example, Larsen et al. in Polymer Testing 96 (2021), 107058 describe and evaluate different methods, in particular for determining the PE content in recycled PP.

HDPE Stream Test

For the HDPE stream the control sample and thus virgin polymer may be selected from the following resins:

| Resin | Density in g/cm³ | Melt-flow index at 190° C./2.16 kg in g/10 min |
|---|---|---|
| ENI Versalis Eraclene BC82 | 0.954 | 0.25 |
| Chevron Phillips Marlex ® HHM 5502BN | 0.955 | 0.35 |
| Dow UNIVAL ™ DMDA-6230 NT 7 | 0.949 | 0.25 |
| INEOS Rigidex ® HD5502S | 0.954 | 0.20 |
| INEOS Rigidex ® HD5802BM | 0.958 | 0.30 |
| LyondellBasell Hostalen GF4750 | 0.950 | 0.40 |
| REPSOL Alcudia ® 5503 | 0.955 | 0.25 |

For Example 1, REPSOL Alcudia® 5503 was chosen as control sample.

Material Preparation

Each the control resin and the package material are separately ground to flakes of 3 to 15 mm. For Example 1, a total of 13.96 kg of packaging material before grinding was employed. For Example 2, a total of 19.00 kg of packaging material before grinding was employed. A central granulator E35.40 from Wanner-Technik at a throughput of 45-60 kg/h, using a 6 mm sieve was used. Afterwards, the flakes of the control resin and package material are separately washed in a vessel employing a 1:4 ratio by weight with tap water. The sample/water mixture is heated to 40° C. and the washed for 5 min with constant steering. The flakes are rinsed in a strainer with cold running tap water, stirred for 5 min and dried. For Examples 1 and 2, a 100 L-vessel with a paddle stirrer and an electrical heating unit was used for washing and the following floatation. The materials were isolated by means of a sieve with a mesh size of 1 mm.

After the washing, the flakes of the package material are subjected to a floatation process. A vessel is filled with the flakes and tap water at a 1:6 ratio. The sample/water mixture is stirred for 2 min with constant steering. Then the stirrer is stopped and the mixture allowed to rest for 2 min. All floating materials are removed with a sieve. For Examples 1 and 2, no sinking fraction was observed. The efficiency of the floatation process is measured using 50 g of the washed flakes of the package material and 700 mL of tap water (pH=7). The water is boiled for 10 min in a beaker and is cooled to room temperature. A volume of 300 mL water is transferred into a high-walled 600 mL beaker and the flakes of package material are added. The mixture is stirred constantly for 2 min and successively allowed to rest for 2 min. The floating fraction is collected and dried (for Example 1 for 1 h at 80° C., for Example 2 at room temperature). Afterwards, the flake moisture is reduced with ambient air to release surface moisture to less than 1% and reported to the nearest 0.1% by weight of the total material. For Example 1, moisture content was determined to be less than 0.05% by weight with a moisture analyzer after drying. For Example 2, moisture content was determined to be 0.25% by weight with a moisture analyzer after drying.

Pellet Preparation

Three sets of flake blends are prepared by manually mixing the flakes of the control resin and package material before extrusion containing 100% by weight control resin (=$PR_{control}$); 75% by weight control resin and 25% by weight package material (=$PR_{25}$) and 50% by weight control resin and 50% by weight package material (=$PR_{50}$). Analogously, a fourth flake blend comprising 100% by weight package material (=$PR_{100}$) may be prepared. The sets are dried in a bed desiccant for 1 h at 80° C. or with hot air at 90° C. for 1 h. Blends are extruded using co-rotative twin-screw extrusion at a temperature of 220° C. The extrudate will be melt filtered (about 120 microns filtration). The extrudate is cooled in a water bath and fed into a pelletizer. The pelletizer speed is controlled to get a final pellet with a diameter of 3 mm. For Example 1, three blends $PR_{control}$ (total weight 10 kg), $PR_{25}$ (total weight 8 kg) and $PR_{50}$ (total weight 8 kg) were each dried in a bed desiccant for 1 h at 80° C., for Example 2 the three blends were each dried with hot air for 1 h at 90° C. The extrusion was carried out with a twin-screw extruder (Leistritz LSM 30.34) equipped with an atmospheric pressure degassing unit, a 120 μm melt filter and a 5 mm die. The screw configuration included 2 compression zones of 360 mm and 720 mm length and 1 kneading zone of 112.5 mm length with a stagger angle rising from 60° to 90°. Every heating zone along the barrel was set to 220° C. The extrudate was cooled in a water tank and subsequently pelletized. The extruders were cleaned before every extrusion process. This involved pulling the screws out of the barrel and then mechanically cleaning them with brass brushes until they reached a glossy finish. The barrel was also mechanically cleaned with round brass brushes from the mandrel to the run-out zone.

The pellets are then analyzed for their properties according to the following table:

| Property | Method |
|---|---|
| Bulk density in kg/m³ | DIN EN 15344 (B) |
| Density in kg/m³in water | DIN EN ISO 1183-1 (A) |
| Melt-flow index in g/10 min | DIN EN ISO 1133<br>ISO 1872-2 (190° C., 2.16 kg) |
| Ash content in wt.-% | DIN EN ISO 11358 |
| Moisture in wt % | Moisture analyser |
| Volatiles in wt % | Weight loss of 10 g air-dried pellets exposed to 160° C. for 10 minutes; reported to the 0.1 wt % |
| Melt Temperature in ° C. | ISO 11357-3 (Heat-cool-heat cycle at 10°/min from 25° C. to 300° C. with 5 minutes of isotherm between each ramp) |

Product Application Test

Pellets of $PR_{control}$, $PR_{25}$, $PR_{50}$, and optionally $PR_{100}$, are tested for injection molding to evaluate tensile properties, colors, as well as defects. The injection molding process has to be done separately for each of the pellets of $PR_{control}$, $PR_{25}$, $PR_{50}$, and optionally $PR_{100}$. The pellets are dried at 90° C. for 2 hours and then molded at 190-245° C. to multipurpose specimens' type 1A according to EN ISO 527-2. The run time is variable, but should be not less than 30 min. The specimens should be completely filled without any shrinkage, overspray, and inclusions. For Examples 1 and 2, pellets of $PR_{control}$, $PR_{25}$ and $PR_{50}$ were separately dried in a bed desiccant for 2 h at 90° C. and the fractions used for injection molding with the following device settings. An Arburg Allrounder 420 C with a maximum injection pressure of 2500 bar and a clamp force of 1000 kN was used. It was equipped with a plasticizing unit with four heating zones and an individually heated tool.

| Tool | Multipurpose specimens |
|---|---|
| Standard | DIN EN ISO 20753 A1 |
| Tool temperature | 60° C. |
| Closing force | 500 kN |
| Injection pressure | 1350 bar |

-continued

| Tool | Multipurpose specimens |
|---|---|
| Injection time | 0.91 s |
| Heating zone temperature | 240° C. |
| Main holding pressure (time) | 1000 bar (15 s) |

The injection molded multi-purpose specimen are evaluated for the following properties:

| Property | Method |
|---|---|
| Flexural Modulus in MPa | ISO 178 |
| Tensile Stress at Yield in MPa | ISO 527 |
| Tensile Stress at Break in MPa | ISO 527-2 |
| Elongation at Break in % | ISO 527-2 |
| Elongation at Yield in % | ISO 527-2 |
| Charpy Impact Strength in kJ/m$^2$ | ISO 179-2/1eA |

Further, $PR_{control}$, $PR_{25}$, $PR_{50}$, and optionally $PR_{100}$ are tested are tested for bottles blow molding. For this, blends of 50% by weight of pellets $PR_{control}$ and 50% by weight of by virgin material pellets ($PRB_{control}$); of 50% by weight of pellets PR 25 and 50% by weight of virgin material pellets ($PRB_{25}$); of 50% by weight of pellets PR 50 and 50% by weight of virgin material pellets ($PRB_{50}$); and optionally 50% by weight of pellets $PR_{100}$ and 50% by weight of virgin material pellets ($PRB_{100}$) are prepared. The blends $PRB_{control}$, $PRB_{25}$, $PRB_{50}$ and optionally $PRB_{100}$ are blow molded at 170-180° C. into one liter straight-wall generic base monolayer bottle, 1 mm tick. For Examples 1 and 2, blends $PRB_{control}$, $PRB_{25}$ and $PRB_{50}$ were blow molded into 1 L straight-wall monolayer bottles with a height of 240 mm and a rectangular cross section of 84·64 mm$^2$. The edges had radii of 15 mm and 28 mm at the top, 6 mm at the side and 8 mm at the bottom. The bottle had an offset neck and a thread with an outer diameter of 24 mm. Bottles were produced with a Hesta HW551 equipped with a single-screw extruder. The temperatures along the barrel were set to 170-180° C. The pressure was 400 bar. The bottles were blown in a specially made tool at a tool temperature of 15° C.

The bottles are evaluated for the following properties. The samples for the tensile tests are punched from the side walls of the bottles and were tested according to ISO 527.

| Property | Method |
|---|---|
| Bottle height in mm | The bottle is measured with a ruler. The results are reported to the 0.1% in relation to $PRB_{control}$. |
| Bottle weight in g | The bottle is weighted. The results are reported to the 0.1% in relation to $PRB_{control}$. |
| Bottle Capacity in mL | The bottle is brim-fully filled with water and the volume measured. The results are reported to the 0.1% in relation to $PRB_{control}$. |
| Bottle Integrity | Visual inspection |
| Top load in kg | ASTM D2659 |
| Drop impact in m | ASTM D2463, procedure B |
| Tensile Stress at Yield in MPa | ISO 527-2 |
| Tensile Strain at Yield in % | ISO 527-2 |
| Tensile Stress at Break in MPa | ISO 527-2 |

The recyclability of the packages in the HDPE stream is calculated via calculating the % of PE by weight of the total package (including labels and adhesives) and deducting a recyclability penalty of 2% for each parameter criterium not met for the pellets of $PR_{25}$ and $PR_{50}$, the injection molded parts of $PR_{25}$ and $PR_{50}$ and the blow molded bottles of $PRB_{25}$ and $PRB_{50}$. The parameter criteria may be either absolute values or comparative values to the control sample ($PR_{control}$ or $PRB_{control}$).

| Specimen | Property | Criterium |
|---|---|---|
| Pellet | Bulk density in kg/m$^3$ | ≥550 |
| Pellet | Density in kg/m$^3$ in water | 941-970 |
| Pellet | Melt-flow index in g/10 min | 0.2-0.9 |
| Pellet | Ash content in wt.-% | ≤2 |
| Pellet | Moisture in wt % | ≤0.1 |
| Pellet | Volatiles in wt % | 90-110% of $PR_{control}$ value |
| Pellet | Melt Temperature in ° C. | ≤140 |
| Multipurpose specimen | Flexural Modulus in MPa | ≥600 |
| Multipurpose specimen | Tensile Stress at Yield in MPa | ≥18 |
| Multipurpose specimen | Tensile Stress at Break in MPa | ≥75% of $PR_{control}$ value |
| Multipurpose specimen | Elongation at Break in % | ≥75% of $PR_{control}$ value |
| Multipurpose specimen | Elongation at Yield in % | ≥75% of $PR_{control}$ value |
| Multipurpose specimen | Charpy Impact Strength in kJ/m$^2$ | ≥75% of $PR_{control}$ value |
| Bottle | Bottle height in mm | 95-105% of $PRB_{control}$ value |
| Bottle | Bottle weight in g | 95-105% of $PRB_{control}$ value |
| Bottle | Bottle Capacity in mL | 95-105% of $PRB_{control}$ value |
| Bottle | Top load in kg | ≥90% of $PRB_{control}$ value |
| Bottle | Drop impact in m | ≥90% of $PRB_{control}$ value |
| Bottle | Tensile Stress at Yield in MPa | ≥75% of $PRB_{control}$ value |
| Bottle | Tensile Strain at Yield in % | ≥75% of $PRB_{control}$ value |
| Bottle | Tensile Stress at Break in MPa | ≥75% of $PRB_{control}$ value |

LDPE Stream Test

For the LDPE stream the control sample and thus virgin polymer may be selected from the following resins:

| Type of resin | Resin | Density in g/cm$^3$ | Melt-flow index at 190° C./2.16 kg in g/10 min |
|---|---|---|---|
| LDPE | BOREALIS FT5230 | 0.923 | 0.75 |
| LDPE | DOW 310E | 0.923 | 0.75 |
| LDPE | ENI Versalis Riblene FF33 | 0.923 | 0.80 |
| LDPE | ExxonMobil LD150BW | 0.923 | 0.75 |
| LDPE | LyondellBasell Lupolen 2420F | 0.923 | 0.75 |
| LLDPE | Dowlex 2045G | 0.920 | 1.0 |
| LLDPE | Dowlex 2740G | 0.940 | 1.0 |
| LLDPE | Dowlex 2750ST | 0.950 | 1.5 |
| LLDPE | Dowlex 2107GC | 0.917 | 2.3 |

For Example 1, LyondellBasell Lupolen 2420F was chosen as control sample.

Material Preparation

Each the control resin and the package material are separately ground to flakes of 8 to 20 mm. For Example 1, a total of 12.50 kg of packaging material before grinding was used. For Example 2, a total of 20.0 kg of packaging material before grinding was used. Grinding was performed with a granulator G25-30-3K-ARK-SE-A from CMG at a throughput of 5-10 kg/h, using a 8 mm sieve. Afterwards, the flakes of the control resin and package material are separately washed in a vessel employing a 1:24 ratio by weight with tap water. The sample/water mixture is washed for 10 min at room temperature with constant steering. The flakes are rinsed in a strainer with cold running tap water, stirred for 5 min and dried. For Examples 1 and 2, flakes were washed using a Raimondi fluid mixer 75 liter capacity.

After the washing, the flakes of the package material are subjected to a floatation process. A vessel is filled with the flakes and tap water at a 1:24 ratio. The sample/water mixture is stirred for 10 min with constant steering. Then the stirrer is stopped and the mixture allowed to rest for 2 min. All floating materials are removed with a sieve. For Examples 1 and 2, no sinking fraction was observed. Afterwards, the flakes are dried in an oven at 60° C. for 24 h. For Examples 1 and 2, a Memmert oven was used. After these steps a total of 11.385 kg of flakes of package material for Example 1 and 19.285 kg for Example 2 were obtained.

Pellet Preparation

Three sets of flake blends are prepared by manually mixing the flakes of the control resin and package material before extrusion containing 100% by weight control resin (=$PF_{control}$); 75% by weight control resin and 25% by weight package material (=$PF_{25}$) and 50% by weight control resin and 50% by weight package material (=$PF_{50}$). Analogously, a fourth flake blend comprising 100% by weight package material (=$PF_{100}$) may be prepared. The flakes blends are dried for 1 h at 80° C. or with hot air at 90° C. for 1 h and extruded using co-rotative twin-screw extrusion at temperatures of 230° C. The extrudate is melt filtered at 110 microns. For Examples 1 and 2, three pre-blends $PF_{control}$ (total weight 6 kg), $PF_{25}$ (total weight 6 kg) and $PF_{50}$ (total weight 8 kg) were prepared and extruded separately using a Maris 30D co-rotating twin screw extruder TM-HF series, having the following characteristics Barrels l/d=4, Diameters ratio D/d=1.55. Screw speed was maintained at 100 rpm. A filter, having 110 microns dimension was used during the compounding phase.

-continued

| Property | Method |
|---|---|
| Melt-flow index in g/10 min | DIN EN ISO 1133<br>ISO 1872-2 (190° C., 2.16 kg) |
| Ash content in wt.-% | DIN EN ISO 11358 |
| Moisture in wt % | Moisture analyser |
| Volatiles in wt % | Weight loss of 10 g air-dried pellets exposed to 160° C. for 10 minutes; reported to the 0.1 wt % |
| Melt Temperature in ° C. | ISO 11357-3 (Heat-cool-heat cycle at 10°/min from 25° C. to 300° C. with 5 minutes of isotherm between each ramp) |

Product Application Test

Pellets $PF_{control}$, $PF_{25}$, $PF_{50}$ and optionally $PF_{100}$ are tested in blown film production. For this, blends of 50% by weight of pellets $PF_{control}$ and 50% by weight of virgin material pellets ($PFB_{control}$); of 50% by weight of pellets PF 25 and 50% by weight of virgin material pellets ($PFB_{25}$); of 50% by weight of pellets PF 50 and 50% by weight of virgin material pellets ($PFB_{50}$); and optionally of 50% by weight of pellets PF 100 and 50% by weight of virgin material pellets ($PFB_{100}$) are prepared. Blown film with a fixed blow-up ratio of ca. 2.5, at a melt temperature of 200-230° C. and a thickness <25 μm are produced. If the blown film bubble made from for $PF_{25}$ or $PF_{50}$ cannot be maintained stable for 30 min, all properties evaluated for the respective film (see table) are considered failed. For Examples 1 and 2, films were produced using a EUROTECH single screw extruder 25 mm diameter; LD ratio: 30/1 having a die diameter of 30 mm. An extruder temperature of 200° C. and a blown head temperature of 185° C. was used at a speed of 50 rpm.

The blown films are evaluated for the following properties:

| Property | Method |
|---|---|
| Thickness in μm | ISO 4593; DIN 53370 |
| Tear Strength in cross direction in N | DIN EN ISO 6383-2; DIN EN ISO 1974 |
| Tear Strength in machine direction in N | DIN EN ISO 6383-2; DIN EN ISO 1974 |
| Tensile Stress at Yield in cross direction in MPa | ISO 527-3 (Type 2 samples, strain-rate closed to 2 $min^{-1}$) |
| Tensile Stress at Yield in machine direction in MPa | ISO 527-3 (Type 2 samples, strain-rate closed to 2 $min^{-1}$) |
| Elongation at Yield in cross direction in % | ISO 527-3 (Type 2 samples, strain-rate closed to 2 $min^{-1}$) |
| Elongation at Yield in machine direction in % | ISO 527-3 (Type 2 samples, strain-rate closed to 2 $min^{-1}$) |
| Tensile Stress at Break in cross direction in MPa | ISO 527-3 (Type 2 samples, strain-rate closed to 2 $min^{-1}$) |
| Tensile Stress at Break in machine direction in MPa | ISO 527-3 (Type 2 samples, strain-rate closed to 2 $min^{-1}$) |
| Elongation at Break in cross direction in % | ISO 527-3 (Type 2 samples, strain-rate closed to 2 $min^{-1}$) |
| Elongation at Break in machine direction in % | ISO 527-3 (Type 2 samples, strain-rate closed to 2 $min^{-1}$) |
| Dart Impact in g | ISO 7765 |
| Puncture Resistance in N | DIN EN 14477 |

The pellets are then analyzed for their properties according to the following table:

| Property | Method |
|---|---|
| Bulk density in $kg/m^3$ | DIN EN 15344 (B) |
| Density in $kg/m^3$ in water | DIN EN ISO 1183-1 (A) |

The recyclability of the packages in the LDPE stream is calculated via calculating the % of PE by weight of the total package (including labels and adhesives) and deducting a recyclability penalty of 1.5% for each parameter criterium not met for the pellets of $PF_{25}$ and $PF_{50}$ and the films of $PFB_{25}$ and $PFB_{50}$. The parameter criteria may be either absolute values or comparative values to the control sample ($PF_{control}$ or $PFR_{control}$).

| Specimen | Property | Criterium |
|---|---|---|
| Pellet | Bulk density in kg/m$^3$ | ≥500 |
| Pellet | Density in kg/m$^3$ in water | ≤970 |
| Pellet | Melt-flow index in g/10 min | Value of $PF_{control}$ ± 0.75 |
| Pellet | Ash content in wt.-% | ≤1 |
| Pellet | Moisture in wt % | ≤0.1 |
| Pellet | Volatiles in wt % | ≤1.0 |
| Pellet | Melt Temperature in ° C. | ≤150 |
| Film | Tear Strength in cross direction in N | ≥75% of $PFB_{control}$ value |
| Film | Tear Strength in machine direction in N | ≥75% of $PFB_{control}$ value |
| Film | Tensile Stress at Yield in cross direction in MPa | ≥75% of $PFB_{control}$ value |
| Film | Tensile Stress at Yield in machine direction in MPa | ≥75% of $PFB_{control}$ value |
| Film | Elongation at Yield in cross direction in % | ≥75% of $PFB_{control}$ value |
| Film | Elongation at Yield in machine direction in % | ≥75% of $PFB_{control}$ value |
| Film | Tensile Stress at Break in cross direction in MPa | ≥75% of $PFB_{control}$ value |
| Film | Tensile Stress at Break in machine direction in MPa | ≥75% of $PFB_{control}$ value |
| Film | Elongation at Break in cross direction in % | ≥75% of $PFB_{control}$ value |
| Film | Elongation at Break in machine direction in % | ≥75% of $PFB_{control}$ value |
| Film | Dart Impact in g | ≥75% of $PFB_{control}$ value |
| Film | Puncture Resistance in N | ≥75% of $PFB_{control}$ value |

The overall PE recyclability of the packages corresponds to the lower value of the recyclability in the HDPE or LDPE stream.

PP Rigids Stream Test

For the PP rigids stream the control sample and thus virgin polymer may be selected from the following resins:

| Resin | Density in g/cm$^3$ | Melt-flow index at 230° C./2.16 kg in g/10 min |
|---|---|---|
| HC205TF | 0.905 | 4 |
| BH345MO | 0.905 | 45 |

Material preparation, pellet preparation and the product application test are performed analogously to the HDPE stream test employing the same methods and conditions. Also the properties of pellets, specimen and bottles are obtained via the same methods, Also the properties of pellets and films are obtained via the same methods except for the melt-flow index, which is determined according to ISO 1133-1 (230° C./2.16 kg), and the melt temperature, which is determined according to ISO 11357-3 (Heat-cool-heat cycle at 10°/min from 25° C. to 240° C. with 5 minutes of isotherm between each ramp). The different pellets and pellet blends are named $PPR_{control}$, $PPR_{25}$, $PPR_{50}$ and $PPR_{100}$; $PPRB_{control}$, $PPRB_{25}$, $PPRB_{50}$ and $PPR_{100}$ in the following to distinguish between PE and PP samples.

The recyclability of the packages in the PP rigids stream is calculated via calculating the % of PP by weight of the package, including labels and adhesives, and deducting a recyclability penalty of 2% for each parameter criterium not met for the pellets of $PPR_{25}$ and $PPR_{50}$, the injection molded parts of $PPR_{25}$ and $PPR_{50}$ and the blow molded bottles of $PPRB_{25}$ and $PPRB_{50}$. The parameter criteria may be either absolute values or comparative values to the control sample ($PPR_{control}$ or $PPRB_{control}$).

| Specimen | Property | Criterium |
|---|---|---|
| Pellet | Bulk density in kg/m$^3$ | ≥480 |
| Pellet | Density in kg/m$^3$ in water | ≤950 |
| Pellet | Melt-flow index in g/10 min | 85-115% of $PPR_{control}$ value |
| Pellet | Ash content in wt.-% | ≤1 |
| Pellet | Moisture in wt % | ≤0.1 |
| Pellet | Volatiles in wt % | 90-110% of $PPR_{control}$ value |
| Pellet | Melt Temperature in ° C. | ≤170 |
| Multipurpose specimen | Flexural Modulus in MPa | ≥800 |
| Multipurpose specimen | Tensile Stress at Yield in MPa | ≥18 |
| Multipurpose specimen | Tensile Stress at Break in MPa | ≥90% of $PPR_{control}$ value |
| Multipurpose specimen | Charpy Impact Strength in kJ/m$^2$ | ≥90% of $PPR_{control}$ value |
| Bottle | Bottle height in mm | 98-102% of $PPRB_{control}$ value |
| Bottle | Bottle weight in g | 98-102% of $PPRB_{control}$ value |
| Bottle | Bottle Capacity in mL | 98-102% of $PPRB_{control}$ value |
| Bottle | Top load in kg | ≥90% of $PPRB_{control}$ value |
| Bottle | Drop impact in m | ≥90% of $PPRB_{control}$ value |
| Bottle | Tensile Stress at Yield in MPa | ≥75% of $PPRB_{control}$ value |
| Bottle | Tensile Strain at Yield in % | ≥75% of $PPRB_{control}$ value |
| Bottle | Tensile Stress at Break in MPa | ≥75% of $PPRB_{control}$ value |

PP Flexibles Stream Test

For the PP flexibles stream the control sample and thus virgin polymer may be selected from the following:

For packages comprising a cast film flexible package body, granules of 70% by weight of homopolymer with a MFR at 230° C. g/10 min in the range of 2 to 8 and a melting temperature of 162° C. and 30% by weight of a random copolymer with a MFR at 230° C. g/10 min in the range of 2 to 8 and a melting temperature of 160° C. constitute the control sample and thus virgin polymer. For packages comprising a BOPP film flexible package body, granules of 90% by weight of homopolymer with a MFR at 230° C. g/10 min in the range of 2 to 3.2 and a melting temperature of 161° C. and 10% by weight of a terpolymer with a MFR at 230° C. g/10 min in the range of 2 to 6 and a melting temperature of 130° C. constitute the control sample and thus virgin polymer.

Material preparation and pellet preparation are performed analogously to the LDPE stream test employing the same methods and conditions, except that the extrusion is done at 250° C. Also the properties of pellets and films are obtained via the same methods except for the melt-flow index, which is determined according to ISO 1133-1 (230° C./2.16 kg), and the melt temperature, which is determined according to ISO 11357-3 (Heat-cool-heat cycle at 10°/min from 0° C. to 250° C. with 5 minutes of isotherm between each ramp).

The different pellets and pellet blends are named $PPF_{control}$, $PPF_{25}$, $PPF_{50}$ and $PPF_{100}$; $PPBF_{control}$, $PPBF_{25}$, $PPBF_{50}$ and $PPF_{100}$ in the following to distinguish between PE and PP samples.

Product Application Test

Pellets $PPF_{control}$, $PPF_{25}$, $PPF_{50}$ and optionally $PPF_{100}$ are tested are tested in cast film production. For this, blends of 50% by weight of pellets $PPF_{control}$ and 50% by weight of virgin material pellets ($PPFB_{control}$); of 50% by weight of pellets $PPF_{25}$ and 50% by weight of virgin material pellets ($PPFB_{25}$); of 50% by weight of pellets $PPF_{50}$ and 50% by weight of virgin material pellets ($PPFB_{50}$); and optionally of 50% by weight of pellets $PPF_{100}$ and 50% by weight of virgin material pellets ($PPFB_{100}$) are prepared. Cast films at a melt temperature of 250-270° C., chill roll temperature of 50-60° C. and a thickness of 35 μm are produced.

The recyclability of the packages in the PP flexibles stream is calculated via calculating the % of PP by weight of the package, including labels and adhesives, and deducting a recyclability penalty of 1.5% for each parameter criterium not met for the pellets of $PPF_{25}$ and $PPF_{50}$ and the films of $PPFB_{25}$ and $PPFB_{50}$. The parameter criteria may be either absolute values or comparative values to the control sample ($PPF_{control}$ or $PPFB_{control}$).

| Specimen | Property | Criterium |
|---|---|---|
| Pellet | Bulk density in kg/m³ | ≥480 |
| Pellet | Density in kg/m³ in water | ≤950 |
| Pellet | Melt-flow index in g/10 min | 85-115% of $PPF_{control}$ value |
| Pellet | Ash content in wt.-% | ≤2 |
| Pellet | Moisture in wt % | ≤0.1 |
| Pellet | Volatiles in wt % | PPFcontrol value ± 0.1 wt % |
| Pellet | Melt Temperature in ° C. | ≤170 |
| Film | Tear Strength in cross direction in N | ≥75% of $PPFB_{control}$ value |
| Film | Tear Strength in machine direction in N | ≥75% of $PPFB_{control}$ value |
| Film | Tensile Stress at Yield in cross direction in MPa | ≥75% of $PPFB_{control}$ value |
| Film | Tensile Stress at Yield in machine direction in MPa | ≥75% of $PPFB_{control}$ value |

-continued

| Specimen | Property | Criterium |
|---|---|---|
| Film | Elongation at Yield in cross direction in % | ≥75% of $PPFB_{control}$ value |
| Film | Elongation at Yield in machine direction in % | ≥75% of $PPFB_{control}$ value |
| Film | Tensile Stress at Break in cross direction in MPa | ≥75% of $PPFB_{control}$ value |
| Film | Tensile Stress at Break in machine direction in MPa | ≥75% of $PPFB_{control}$ value |
| Film | Elongation at Break in cross direction in % | ≥75% of $PPFB_{control}$ value |
| Film | Elongation at Break in machine direction in % | ≥75% of $PPFB_{control}$ value |
| Film | Dart Impact in g | ≥75% of $PPFB_{control}$ value |
| Film | Puncture Resistance in N | ≥75% of $PFB_{control}$ value |

The overall PP recyclability of the packages corresponds to the lower value of the recyclability in the PP rigids or PP flexibles stream.

EXAMPLES

Example 1

A flexible package body with a total weight of 4.20 g was formed of Constantia EcoLam, a mono PE multi-layer reverse printed flow wrap film. The film consisted of an outer mono-directional oriented PE layer, an inner sealing PE layer, reverse print and lamination adhesive. The flexible package body contained 84.0% of PE by weight. The sealing window was determined to have a range of 20 Kelvin. A fitment was injection molded with a resin comprising 60% by weight of LyondellBasell Hostalen GC 7260, a HDPE, and 40% by weight of LyondellBasell Lupolen 1800U, a LDPE. LyondellBasell Hostalen GC 7260 exhibits a MFI of 8.0 g/10 min (190° C., 2.16 kg), a density of 0.960 g/cm³ and a flexular modulus of 1440 MPa. The fitment had a total weight of 6.02 g. The fitment was adhered to the flexible package body via 0.25 g of adhesive. The adhesive comprised Licocene propylene-ethylene copolymers PP 1602, PP 3602 and PPA 330 from Clariant and Vistamaxx, a polypropylene polymer from ExxonMobil primarily composed of isotactic propylene repeat units with random ethylene distribution, as backbone polymer. The adhesive further comprised HM-1000 Hydrogenated C9 from Henghe materials technology Co., Ltd. as tackifier. The package of Example 1 thus comprised 91.2% by weight of PE.

For the HDPE stream test REPSOL Alcudia 5503 was chosen as control material. For the LDPE stream test LyondellBasell Lupolen2420F was chosen as control material.

The properties of the pellets, the multipurpose specimen and bottles according to the HDPE stream test were determined for Example 1.

| Form | Property | $PR_{control}$ | $PR_{25}$ | $PR_{50}$ |
|---|---|---|---|---|
| Pellet | Bulk density in kg/m³ | 563 | 560 | 575 |
| Pellet | Density in kg/m³ in water | 946 | 949 | 948 |
| Pellet | Melt-flow index in g/10 min | 0.13 | 0.33 | 0.69 |
| Pellet | Ash content in wt.-% | 0% | 0.64% | 1.51% |
| Pellet | Moisture in wt % | 0.07 | 0.07 | 0.02 |
| Pellet | Volatiles in wt % | 0.14 | 0.14 | 0.14 |
| Pellet | Melt Temperature in ° C. | 130.5 | 129.1 | 128.7 |

-continued

| Form | Property | $PR_{control}$ | $PR_{25}$ | $PR_{50}$ |
|---|---|---|---|---|
| Multipurpose specimen | Flexural Modulus in MPa | 779 | 628 | 528 |
| Multipurpose specimen | Tensile Stress at Yield in MPa | 23.7 | 19.7 | 16.5 |
| Multipurpose specimen | Tensile Stress at Break in MPa | 12.0 | 13.3 | 13.8 |
| Multipurpose specimen | Elongation at Break in % | 68.3 | 138 | 506 |
| Multipurpose specimen | Elongation at Yield in % | 17.6 | 19.2 | 19.7 |
| Multipurpose specimen | Charpy Impact Strength in $kJ/m^2$ | 16.1 | 22.6 | 24.3 |

| Form | Property | $PRB_{control}$ | $PRB_{25}$ | $PRB_{50}$ |
|---|---|---|---|---|
| Bottle | Bottle height in mm | 239.97 | 240.25 | 239.75 |
| Bottle | Bottle weight in g | 50.16 | 51.80 | 54.87 |
| Bottle | Bottle Capacity in mL | 1165 | 1159 | 1152 |
| Bottle | Top load in kg | 5.72 | 5.26 | 5.06 |
| Bottle | Drop impact in m | 2.24 | 2.24 | 2.46 |
| Bottle | Tensile Stress at Yield in MPa | 21.2 | 18.6 | 18.6 |
| Bottle | Tensile Strain at Yield in % | 14.2 | 14.2 | 15.0 |
| Bottle | Tensile Stress at Break in MPa | 14.8 | 12.7 | 13.4 |

Example 1 did not match 4 criteria of the HDPE stream test, 2 each for the specimen made from PR50 and the bottle made from $PRB_{50}$. Hence, Example 1 has a recyclability of 83.2% in the HDPE stream.

The properties of the pellets and film according to the LDPE stream test were determined for Example 1.

| Form | Property | $PF_{control}$ | $PF_{25}$ | $PF_{50}$ |
|---|---|---|---|---|
| Pellet | Bulk density in $kg/m^3$ | 486 | 518 | 530 |
| Pellet | Density in $kg/m^3$ in water | 921 | 929 | 937 |
| Pellet | Melt-flow index in g/10 min | 0.639 | 1.057 | 2.103 |
| Pellet | Ash content in wt.-% | 0.01 | 0.74 | 1.51 |
| Pellet | Moisture in wt % | 0.01 | 0.03 | 0.04 |
| Pellet | Volatiles in wt % | 0.022 | 0.027 | 0.018 |
| Pellet | Melt Temperature in ° C. | 114.8 | 126.5 | 126.3 |

| Form | Property | $PFB_{control}$ | $PFB_{25}$ | $PFB_{50}$ |
|---|---|---|---|---|
| Film | Tear Strength in cross direction in N | 2.25 | 2.64 | 3.30 |
| Film | Tear Strength in machine direction in N | 2.20 | 2.96 | 2.93 |
| Film | Tensile Stress at Yield in cross direction in MPa | 10.5 | 8.7 | 6.8 |
| Film | Tensile Stress at Yield in machine direction in MPa | 10.9 | 10.5 | 10.3 |
| Film | Elongation at Yield in cross direction in % | 10 | 10 | 10 |
| Film | Elongation at Yield in machine direction in % | 10 | 10 | 10 |
| Film | Tensile Stress at Break in cross direction in MPa | 18.9 | 11.0 | 11.6 |
| Film | Tensile Stress at Break in machine direction in MPa | 22.8 | 22.3 | 16.1 |
| Film | Elongation at Break in cross direction in % | 371 | 345 | 370 |

-continued

| Form | Property | $PFB_{control}$ | $PFB_{25}$ | $PFB_{50}$ |
|---|---|---|---|---|
| Film | Elongation at Break in machine direction in % | 231 | 222 | 157 |
| Film | Dart Impact in g | 171 | 137 | 131 |
| Film | Puncture Resistance in N | 1.25 | 1.14 | 0.9 |

Example 1 did not match 8 criteria of the LDPE stream test, 2 for the $PF_{50}$ pellets, 1 for the film made from $PFB_{25}$ and 5 for the film made from $PFB_{50}$. Hence, Example 1 has a recyclability of 79.2% of in the LDPE stream.

The overall PE recyclability of Example 1 is thus 79.2%.

Pellets comprising 100% by weight of package material (PF100) were prepared according to the material preparation of the LDPE stream test of the Recycling Rate Test method. The PF100 pellets of Example 1 exhibited a bulk density of 558 $kg/m^3$; a density in water of 952 $kg/m^3$ and a melt temperature of 127.5° C., while a second very low intensity peak was observed at 103.4° C. in the thermogram. The moisture and volatile contents were determined to be low at 0.08 wt.-% and 0.16 wt.-%.

Example 2

A flexible package body with a total weight of 4.23 g was formed of Constantia EcoLam, a mono PE multi-layer reverse printed flow wrap film. The film consisted of an outer mono-directional oriented PE layer with an inner sealing PE layer, reverse print and lamination adhesive. The flexible package body contained 3.55 g of PE and thus contained 83.9% of PE by weight. The sealing window was determined to have a range of 20 Kelvin. A fitment was injection molded with a resin comprising 43% by weight of LyondellBasell Hostalen GC 7260, a HDPE, and 55% by weight of Nova Chemicals SCLAIR 2815 Resin, a HDPE. Nova Chemicals SCLAIR 2815 Resin exhibits a MFI of 69.0 g/10 min (190° C., 2.16 kg), a density of 0.952 $g/cm^3$ and a flexular modulus of 1070 MPa. 2% by weight of the fitment were processing aids and colorants. The fitment had a total weight of 6.44 g. The fitment was adhered to the flexible package body via 0.25 g of adhesive. The adhesive comprised Licocene propylene-ethylene copolymers PP 1602, PP 3602 and PPA 330 from Clariant and Vistamaxx, a polypropylene polymer from ExxonMobil primarily composed of isotactic propylene repeat units with random ethylene distribution, as backbone polymer. The adhesive further comprised HM-1000 Hydrogenated C9 from Henghe materials technology Co., Ltd. as tackifier. The package of Example 2 thus comprised 90.3% by weight of PE.

For the HDPE stream test ENI Versalis Eraclene BC82 was chosen as control material. For the LDPE stream test DOW 310E was chosen as control material.

The properties of the pellets, the multipurpose specimen and bottles according to the HDPE stream test were determined for Example 2.

| Form | Property | $PR_{control}$ | $PR_{25}$ | $PR_{50}$ |
|---|---|---|---|---|
| Pellet | Bulk density in $kg/m^3$ | 583 | 575 | 555 |
| Pellet | Density in $kg/m^3$ in water | 947 | 952 | 941 |
| Pellet | Melt-flow index in g/10 min | 0.22 | 0.58 | 1.23 |
| Pellet | Ash content in wt.-% | 0.0% | 0.6% | 1.5% |
| Pellet | Moisture in wt % | 0.07 | 0.08 | 0.08 |

-continued

| Form | Property | $PR_{control}$ | $PR_{25}$ | $PR_{50}$ |
|---|---|---|---|---|
| Pellet | Volatiles in wt % | 0.12 | 0.14 | 0.14 |
| Pellet | Melt Temperature in ° C. | 130.5 | 129.6 | 129.3 |
| Multipurpose specimen | Flexural Modulus in MPa | 838 | 747 | 679 |
| Multipurpose specimen | Tensile Stress at Yield in MPa | 23.1 | 21.0 | 19.2 |
| Multipurpose specimen | Tensile Stress at Break in MPa | 11.1 | 12.0 | 12.2 |
| Multipurpose specimen | Elongation at Break in % | 62.3 | 92.2 | 182.3 |
| Multipurpose specimen | Elongation at Yield in % | 11.1 | 12.0 | 12.2 |
| Multipurpose specimen | Charpy Impact Strength in $kJ/m^2$ | 16.3 | 14.5 | 9.0 |

| Form | Property | $PRB_{control}$ | $PRB_{25}$ | $PRB_{50}$ |
|---|---|---|---|---|
| Bottle | Bottle height in mm | 240.34 | 240.19 | 240.23 |
| Bottle | Bottle weight in g | 49.90 | 51.23 | 50.73 |
| Bottle | Bottle Capacity in mL | 1162 | 1161 | 1162 |
| Bottle | Top load in kg | 7.07 | 6.77 | 6.07 |
| Bottle | Drop impact in m | 1.84 | 1.76 | 1.71 |
| Bottle | Tensile Stress at Yield in MPa | 23.5 | 23.8 | 23.5 |
| Bottle | Tensile Strain at Yield in % | 14.9 | 14.9 | 14.6 |
| Bottle | Tensile Stress at Break in MPa | 13.0 | 13.7 | 13.3 |

Example 2 did not match 3 criteria of the HDPE stream test, 1 each for the pellet properties of $PR_{50}$, the specimen made from $PR_{50}$ and the bottle made from $PRB_{50}$. Hence, Example 2 has a recyclability of 84.3% in the HDPE stream.

The properties of the pellets and film according to the LDPE stream test were determined for Example 2.

| Form | Property | $PF_{control}$ | $PF_{25}$ | $PF_{50}$ |
|---|---|---|---|---|
| Pellet | Bulk density in $kg/m^3$ | 499 | 513 | 526 |
| Pellet | Density in $kg/m^3$ in water | 923 | 929 | 937 |
| Pellet | Melt-flow index in g/10 min | 0.61 | 1.33 | 2.24 |
| Pellet | Ash content in wt.-% | 0.01% | 0.75% | 1.74% |
| Pellet | Moisture in wt % | 0.04 | 0.05 | 0.05 |
| Pellet | Volatiles in wt % | 0.02 | 0.02 | 0.03 |
| Pellet | Melt Temperature in ° C. | 112.2 | 125.6 | 126.3 |

| Form | Property | $PFB_{control}$ | $PFB_{25}$ | $PFB_{50}$ |
|---|---|---|---|---|
| Film | Tear Strength in cross direction in N | 1.79 | 2.40 | 3.53 |
| Film | Tear Strength in machine direction in N | 3.09 | 3.87 | 3.53 |
| Film | Tensile Stress at Yield in cross direction in MPa | 9.9 | 11.2 | 12.4 |
| Film | Tensile Stress at Yield in machine direction in MPa | 11.3 | 11.2 | 13.0 |
| Film | Elongation at Yield in cross direction in % | 5.9 | 6.3 | 6.0 |
| Film | Elongation at Yield in machine direction in % | 10 | 10 | 10 |
| Film | Tensile Stress at Break in cross direction in MPa | 14.0 | 13.1 | 16.0 |

-continued

| Form | Property | $PFB_{control}$ | $PFB_{25}$ | $PFB_{50}$ |
|---|---|---|---|---|
| Film | Tensile Stress at Break in machine direction in MPa | 22.8 | 23.0 | 24.8 |
| Film | Elongation at Break in cross direction in % | 386 | 334 | 495 |
| Film | Elongation at Break in machine direction in % | 150 | 206 | 222 |
| Film | Dart Impact in g | 57 | 57 | 57 |
| Film | Puncture Resistance in N | 1.51 | 1.56 | 1.40 |

Example 2 did not match 3 criteria of the LDPE stream test, 1 for the PF25 pellets and 2 for the PF50 pellets. All film criteria were met for Example 2. Hence, Example 2 has a recyclability of 85.8% of in the LDPE stream.

The overall PE recyclability of Example 2 is thus 84.3%.

Pellets comprising 100% by weight of package material (PF100) were prepared according to the material preparation of the LDPE stream test of the Recycling Rate Test method. The PF100 pellets of Example 2 exhibited a bulk density of 555 $kg/m^3$; a density in water of 948 $kg/m^3$ and a melt temperature of 129.1° C. The moisture and volatile contents were determined to be at 0.01 wt.-% and 0.24 wt.-%.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A package for disposable wipes, the package comprising:

a dispensing fitment formed of a first polymer composition, the first polymer composition comprising polyethylene;

a flexible package body formed of a second polymer composition and optionally lamination adhesives and lamination hardeners, the second polymer composition comprising polyethylene; and a dispensing fitment adhesive disposed between the dispensing fitment and the flexible package body;

wherein the first and second polymer composition may be the same or different, and wherein first polymer composition comprises a first PE resin and a second PE resin different from the first PE resin; wherein the first PE resin exhibits a melt-flow index (MFI) from 30.00 g/10 min to 80.00 g/10 min and the second PE resin exhibits a melt-flow index (MFI) from 1.00 g/10 min to 30.00 g/10 min, measured according to DIN EN ISO 1133/ISO 1872-2 (190° C., 2.16 kg).

2. The package of claim 1, wherein the polyethylene comprised by the first polymer composition and/or the second polymer composition is selected from the group consisting of high-density polyethylene (HDPE), low-density polyethylene (LDPE), linear low-density polyethylene (LLDPE) and any combinations thereof.

3. The package of claim 1, wherein the first polymer composition comprises at least 70% of polyethylene by weight of the first polymer composition.

4. The package of claim 1, wherein the second polymer composition comprises at least 70% of polyethylene by weight of the second polymer composition.

5. The package of claim 1, wherein the package comprises at least 70% of polyethylene by weight of the package.

6. The package of claim 1, wherein the first polymer composition comprises between 20% and 80% of HDPE by weight of the first polymer composition.

7. The package of claim 1, wherein the first polymer composition comprises between 50% and 80% HDPE by weight of the first polymer composition and the second polymer composition comprises less than 50% HDPE by weight of the second polymer composition.

8. The package of claim 1, wherein first polymer composition comprises from 20% and 80% of the first PE resin and from 20% and 80% of the second PE resin by weight of the first polymer composition.

9. The package of claim 1, wherein the first polymer composition and/or the second polymer composition consists of polyethylene optionally in combination with additives.

10. The package of claim 1, wherein the dispensing fitment adhesive is a hotmelt adhesive.

11. The package of claim 1, wherein the dispensing fitment adhesive comprises one or more polyolefin polymers.

12. The package of claim 11, wherein the one or more polymers of the dispensing fitment adhesive are obtained by copolymerization of ethylene or propylene with a linear or branched monoalkene, preferably by copolymerization of ethylene with a linear alpha-olefin.

13. The package of claim 1, wherein the dispensing fitment adhesive is pressure sensitive.

14. The package of claim 1, wherein the flexible package body comprises a mono-material film selected from the group consisting of laminated multi-layer film, co-extruded multi-layer and single layer film.

15. The package of claim 1, wherein the flexible package body exhibits a near infra-red (NIR) response, which is substantially the same on any surface.

16. The package of claim 1, wherein the flexible package body comprises a weakened region to facilitate creation of a dispensing opening upon first opening of the package and wherein the dispensing fitment is disposed over the weakened region.

17. The package of claim 1, wherein the dispensing fitment is formed via an injection molding process and optionally comprises an in-mold label preferably made from PE.

18. The package of claim 1, wherein the first polymer composition and/or the second polymer composition comprises bio-based resin, in particular bio-based PE resin.

19. The package of claim 1, wherein the first polymer composition and/or the second polymer composition comprises recycled resin, in particular recycled PE resin.

20. The package of claim 1, wherein the package encloses disposable wipes having a recyclable substrate.

* * * * *